US008928429B2

(12) United States Patent
Song et al.

(10) Patent No.: US 8,928,429 B2
(45) Date of Patent: Jan. 6, 2015

(54) MULTIPLE-WAY RING CAVITY POWER COMBINER AND DIVIDER

(75) Inventors: Kaijun Song, Chengdu (CN); Xue Quan, Hong Kong (CN)

(73) Assignee: City University of Hong Kong, Kowloon (HK)

( * ) Notice: Subject to any disclaimer, the term of this patent is extended or adjusted under 35 U.S.C. 154(b) by 457 days.

(21) Appl. No.: 13/109,305

(22) Filed: May 17, 2011

(65) Prior Publication Data

US 2012/0293274 A1 Nov. 22, 2012

(51) Int. Cl.
*H01P 5/12* (2006.01)
*H01P 5/103* (2006.01)

(52) U.S. Cl.
CPC . *H01P 5/12* (2013.01); *H01P 5/103* (2013.01)
USPC ..... 333/125

(58) Field of Classification Search
CPC ..... H01P 5/12; H01P 5/103
USPC ..... 333/125, 127, 128, 134–137, 124
See application file for complete search history.

(56) References Cited

U.S. PATENT DOCUMENTS

| | | | | |
|---|---|---|---|---|
| 4,263,568 | A * | 4/1981 | Nemit | 333/127 |
| 4,956,614 | A * | 9/1990 | Baril | 330/286 |
| 5,142,253 | A * | 8/1992 | Mallavarpu et al. | 333/127 |
| 5,256,988 | A * | 10/1993 | Izadian | 330/295 |
| 6,788,165 | B2 | 9/2004 | Runyon | |
| 6,897,739 | B2 | 5/2005 | Chan et al. | |
| 6,906,373 | B2 | 6/2005 | Lee | |
| 7,205,865 | B2 | 4/2007 | Kang et al. | |
| 8,319,583 | B2 * | 11/2012 | Huettner | 333/136 |
| 2010/0026416 | A1 | 2/2010 | Ryou | |
| 2010/0244981 | A1 | 9/2010 | Gorbachov | |

FOREIGN PATENT DOCUMENTS

| | | |
|---|---|---|
| CA | 2072392 | 6/1992 |
| WO | 2005078855 | 4/2005 |

OTHER PUBLICATIONS

Kaijun Song, Quan Xue, "Novel Ultra-Wideband (UWB) Multilayer Slotline Power Divider with Bandpass Response," IEEE Microwave and Wireless Components Letters, Jan. 2010, vol. 20, No. 1, pp. 13-15.

Kaijun Song, Yong Fan, Quan Xue, "Millimeter-wave power amplifier based on coaxial-waveguide power-combining circuits", IEEE Microwave and Wireless Components Letters, Jan. 2010, vol. 20, No. 1, pp. 46-48.

Kaijun Song, Quan Xue: "Planar Probe Coaxial-Waveguide Power Combiner/Divider", IEEE Transactions on Microwave Theory and Techniques, Nov. 2009, vol. 57, No. 11, pp. 2761-2767.

(Continued)

*Primary Examiner* — Benny Lee
*Assistant Examiner* — Rakesh Patel
(74) *Attorney, Agent, or Firm* — Amin, Turocy & Watson, LLP

(57) ABSTRACT

Multiple-way ring cavity power combiners and power dividers are disclosed. In one aspect, the disclosed ring cavity power combiners and power dividers can support a large number of devices by providing a large number of power-combining or power-dividing ports. In another aspect, the disclosed embodiments describe implementations employing a ring cavity that result in demonstrated performance characteristics suitable for UWB applications. Advantages provided include suppressing higher order modes and low losses among other advantages.

22 Claims, 16 Drawing Sheets

(56) References Cited

OTHER PUBLICATIONS

K. Song, Y. Fan, X. Zhou: "Broadband Radial Waveguide Power Amplifier Using a Spatial Power Combining Technique", IET Microwaves, Antennas & Propagation, vol. 3, No. 8, pp. 1179-1185, Dec. 2009.

Kaijun Song, Yong Fan, Yonghong Zhang: "Eight-Way Substrate Integrated Waveguide Power Divider with Low Insertion Loss", IEEE Transactions on Microwave Theory and Techniques, Jun. 2008, vol. 56, (6), pp. 1473-1477.

Kaijun Song, Yong Fan, Zongrui He:"Broadband radial waveguide spatial combiner", IEEE Microwave and Wireless Components Letters. Feb. 2008, vol. 18, (2),pp. 73-75.

Kaijun Song, Yong Fan, Yonghong Zhang: "Investigation of a power divider using a coaxial probe array in a coaxial waveguide," IET Microwaves, Antennas & Propagation, Aug. 2007, 1, (4), pp. 900-903.

Kaijun Song, Yong Fan, Yonghong Zhang: "Broad-band power divider based on radial waveguide", Microwave and Optical Technology Letters. 2007, vol. 49, (3), pp. 595-597.

* cited by examiner

MULTIPLE-WAY RING CAVITY POWER COMBINER AND DIVIDER

FIELD OF THE INVENTION

The subject disclosure is directed to power combining and power dividing and, more specifically, relates to multiple-way ring cavity power combiners and power dividers.

BACKGROUND OF THE INVENTION

Broadband solid-state power amplifiers (SSPA) with high power and high efficiency are of interest for many radio frequency (RF) applications as an attractive alternative to vacuum tube technologies. For instance, applications such as ultra-wideband (UWB) communication systems, satellite communication systems, commercial communications, and radar transmitters, are but a few systems that can benefit from high power and high efficiency broadband SSPAs. However, power amplifier technologies can suffer from various limitations such as, for example, limited bandwidth, limited output power, excessive losses, inconvenient or unfortunate sizing or configuration, etc. Power combining can be employed to overcome many of these limitations, but in certain instances, it may involve additional consideration. For example, broadband high efficiency amplifiers can be demonstrated by combining output power from a number of solid-state devices at microwave and millimeter-wave frequencies.

For instance, combining power (and dividing power) in high frequency systems can be performed using conventional power dividers. A device for dividing and/or combining high frequency signals is called a power divider or a power combiner. As an example, a power divider can be a circuit or circuit element for dividing input power from an input port and directing it to output ports in an RF circuit. Typically, a power divider can divide power at a predetermined ratio with minimal power loss and with isolation between the output ports. In this manner, the power divider can prevent a change in circuit characteristic due to mutual influence of adjacent ports. In a similar manner, a power divider can be used as a power combiner by switching usage of input and output ports.

As a result, for applications that require a high-power, high-efficiency, broadband, SSPA, due to the aforementioned limitations of single amplifiers, amplifiers are typically combined in power dividing/combining networks to provide high power. Such techniques can be employed as a combiner, for instance, in a transmitter for combining signals from a number of low power devices to form a high power signal for transmission through a single antenna. For example, an amplifier for amplifying wireless signals can have the limitation of a low output power level as previously mentioned. To overcome this limitation, a plurality of low or medium output amplifiers can be connected in parallel to obtain a desired high power output for transmission of the wireless signals. In other implementations as a divider, a signal from a single source, such as an antenna, can be divided into a number of signals, such as for exciting a number of corresponding satellite or radar antennas. Thus, parallel, multiple-way, waveguide-based power dividing/combining network can provide many advantages for broadband RF applications.

However, conventional broadband power-combining techniques for the design of broadband high-power SSPAs demonstrate that challenges remain. For instance, among various types of combiners, radial waveguide spatial power combiners can reduce spill-over losses while demonstrating high power-combining efficiency. In addition, equal power distribution with broadband performance can be achieved in part by appropriate placement of coaxial probes in the radial waveguide. Nonetheless, while such topologies can facilitate providing broadband capability, low loss, good heat sinking capability, and ease of fabrication, practical limitations such as size and performance limitations can limit the number of ports that can be provided in radial waveguide spatial power combiners.

For example, with an increasing number of power-dividing ports, the radius of a radial waveguide or conical line will increase, which can cause higher order modes in the radial waveguide or conical line power dividing cavity due to discontinuities, and which can be difficult or impractical to suppress effectively. These effects can be exacerbated when the number of power-dividing ports of power dividers increases to more than about twenty or thirty. As a result, beyond this conventional limitation the performance of these types of power dividers can deteriorate due to the higher order modes.

The above-described deficiencies of today's power-combining and power-dividing techniques are merely intended to provide an overview of some of the problems of conventional systems, and are not intended to be exhaustive. Other problems with conventional systems and corresponding benefits of the various non-limiting embodiments described herein may become further apparent upon review of the following description.

SUMMARY OF THE INVENTION

The following presents a simplified summary of the specification to provide a basic understanding of some aspects of the specification. This summary is not an extensive overview of the specification. It is intended to neither identify key or critical elements of the specification nor delineate any scope particular to any embodiments of the specification, or any scope of the claims. Its sole purpose is to present some concepts of the specification in a simplified form as a prelude to the more detailed description that is presented later.

In various embodiments, the disclosed subject matter provides multiple-way ring cavity power combiners and power dividers. In an aspect, the disclosed subject matter provides power combiners and power dividers that can accommodate increasing numbers of ports without sacrificing performance. For example, disclosed embodiments provide multiple-way ring cavity power divider (e.g., power divider and/or power combiner) with UWB performance that can provide large numbers (e.g., greater than thirty) of power-dividing ports (e.g., power dividing and/or power combining ports).

Further embodiments of the disclosed subject matter provide methods for power dividing and/or power combining. In addition, various other modifications, alternative embodiments, advantages of the disclosed subject matter, and improvements over conventional power combiners and power dividers are described.

These and other additional features of the disclosed subject matter are described in more detail below.

BRIEF DESCRIPTION OF THE DRAWINGS

The devices, components, assemblies, structures, systems, and methods of the disclosed subject matter are further described with reference to the accompanying drawings in which.

DETAILED DESCRIPTION OF ILLUSTRATIVE EMBODIMENTS

Overview

Figure 1:
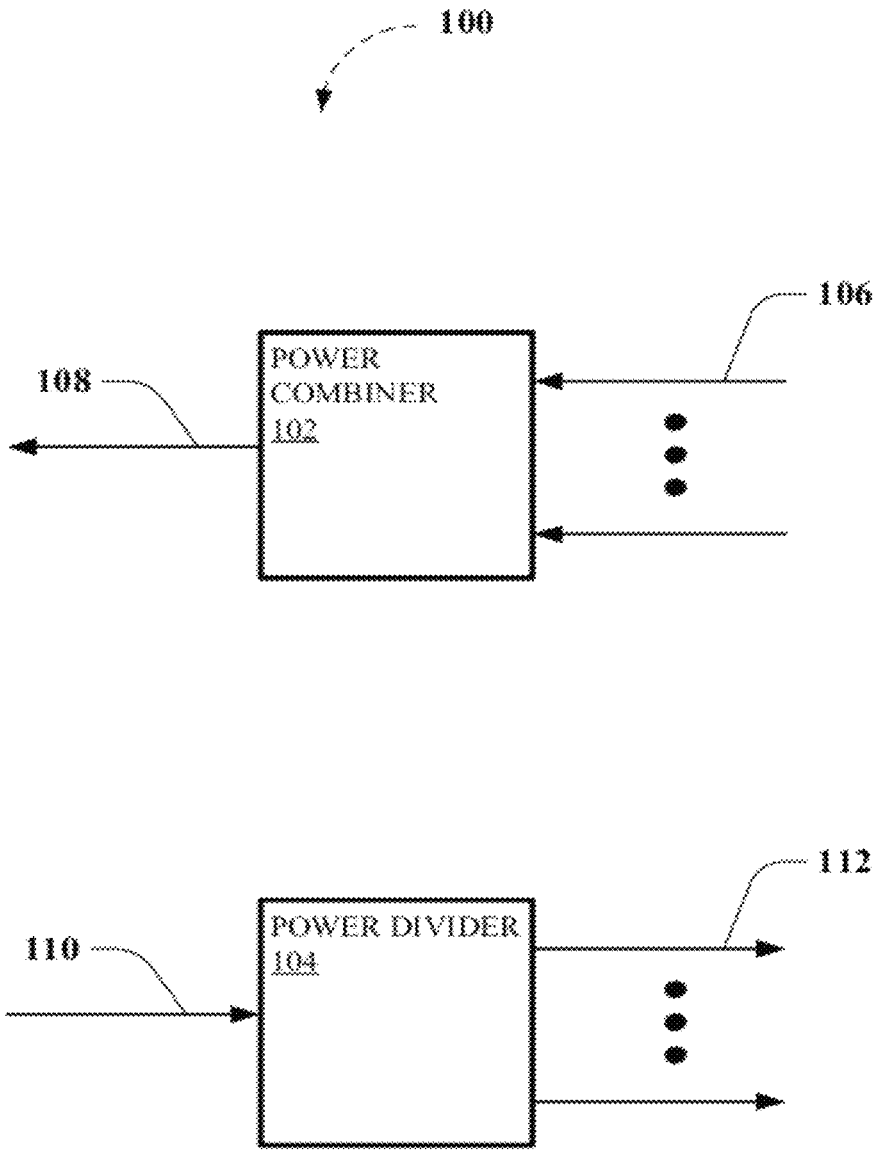
FIG. 1 depicts functional block diagrams of systems suitable for use with exemplary embodiments of the disclosed subject matter.

As used herein, the terms "power divider" and "power combiner" are intended to refer to a component that can be used to facilitate dividing an input signal into multiple output signals and/or combining multiple input signals into a combined output signal, respectively. It can be understood that the terms "power divider" and "power combiner" could be used interchangeably, depending on such things as context of use, configuration, design parameters, and so on, for example, to refer to the component itself, which can facilitate dividing an input signal and/or combining multiple input signals.

In addition, various general references are made herein to Ultra-Wideband (UWB) in the context of describing disclosed embodiments. For instance, UWB can typically refer to radio technologies having bandwidth exceeding the lesser of 500 MegaHertz (MHz) or 20% of the arithmetic center frequency, according to the Federal Communications Commission (FCC). For instance, the FCC authorizes the unlicensed use of UWB in the frequency range of about 3.1 to about 10.6 GigaHertz (GHz). Thus, in various aspects, reference to "UWB performance," "UWB band," and so on can refer to performance characteristics (e.g., insertion loss, amplitude imbalance, phase imbalance, etc.) of devices suitable for operating as UWB devices in a frequency range between about 3.1 to about 10.6 GHz. However, it can be understood that the disclosed subject matter is not so limited. For instance, it can be further understood that various embodiments can be employed in other frequency ranges (e.g., frequencies from about 6 to about 18 GHz, such as for UWB radar, and so on, etc.).

While a brief overview is provided, ring cavities, power dividers, and power combiners and various exemplary signals, are described herein for the purposes of illustration and not limitation. For example, one skilled in the art can appreciate that the illustrative embodiments can have application with respect to other signals and technologies than that which is exemplified.

As described in the background, conventional devices and methods suffer from drawbacks associated with practical limitations of size and performance associated with increasing numbers of signal ports. These and other drawbacks can be appreciated upon review of FIGS. 1-3, which provide additional context surrounding the embodiments of the disclosed subject matter. Thus, in non-limiting implementations, the disclosed subject matter provides multiple-way ring cavity power combiners and power dividers. In an aspect, the disclosed subject matter provides power combiners and power dividers that can accommodate increasing numbers of ports over that of conventional power dividers without sacrificing broadband performance. For example, disclosed embodiments provide multiple-way ring cavity power divider with UWB performance (e.g., insertion loss, amplitude imbalance, phase imbalance, etc.) that can provide large numbers (e.g., greater than thirty) of power-dividing ports (e.g., power dividing and/or power combining ports).

For example, FIG. 1 depicts functional block diagrams of systems 100 suitable for use with exemplary embodiments of the disclosed subject matter comprising a power combiner 102 and/or a power divider 104. As a further example, a system 100 comprising power combiner 102 can further include one or more input signal(s) 106 and an output signal 108. Alternatively, a system 100 comprising power divider 104 can further include an input signal 110 and one or more output signal(s) 112. As described above, it can be understood that a power divider (e.g., power divider 104, etc.) can be used as a power combiner (e.g., power combiner 102, etc.) by switching input and output ports as further described herein.

As further described above, power combiner 102 can be employed as a power combiner, for instance, in a transmitter for combining signals (e.g., one or more input signal(s) 106, etc.) from a number of low power devices to form a high power signal (e.g., output signal 108, etc.) for transmission through a single antenna (not shown). For example, an amplifier for amplifying wireless signals (e.g., one or more input signal(s) 106, etc.) can have the limitation of a low output power level as previously mentioned. To overcome this limitation, a plurality of low or medium output amplifiers can be connected in parallel to obtain a desired high power output (e.g., output signal 108, etc.) for transmission of the wireless signals. In other implementations of a power divider 104, a signal from a single source (e.g., input signal 110, etc.), such as an antenna (not shown), can be divided into a number of signals (e.g., one or more output signal(s) 112, etc.), such as for exciting a number of corresponding satellite or radar antennas (not shown).

Thus, the disclosed parallel, multiple-way, waveguide-based power dividing/combining network can provide many advantages for broadband RF applications. For instance, exemplary non-limiting multiple-way ring cavity power dividers and/or power combiners could be used in high-power solid-state power-combining amplifiers, which are used widely in microwave electronic systems and radar transmitters, as an illustrative example. As a further non-limiting example, various embodiments of the disclosed subject matter can facilitate UWB wireless high-speed communications (e.g., operating in frequency from about 3.1 to about 10.6 GHz, etc.), UWB radar (e.g., operating in frequency from about 6 to about 18 GHz), and so on, due in part to their UWB performance characteristics as demonstrated herein. In another illustrative example, embodiments of the disclosed subject matter be employed in antenna arrays, satellite communication systems, and so on. Thus, the disclosed subject matter can provide power combiners and/or power dividers as a result of the attendant characteristics (e.g., reduced size, low losses, high efficiency, ultra-wideband, high power handling capability, excellent balance of amplitude and phase, low supply voltage, and etc.).

As a result, embodiments of the disclosed subject matter (e.g., UWB multiple-way ring cavity power-combining, etc.) can be employed in many applications, for instance, in communication systems applications. For example, because of the ability of the various non-limiting implementations to successfully implement multiple-way dividers/combiners (e.g., more than about thirty) and low insertion loss, exemplary embodiments can be employed in high-power and high-efficiency solid-state power-combining amplifiers for communication systems applications, radar transmitters, UWB (e.g., frequency ranging from about 3.1 to about 10.6 GHz, etc.) wireless high-speed communication systems applications, and so on. Additionally, because of the attendant small size, high-efficiency, high-power, and low supply voltage performance, the various embodiments as described herein are particularly suitable for satellite communication systems applications, terrestrial communication systems applications such as in airplane-based communication systems, space electrical systems applications, and so on, etc. as well as in antenna arrays, and the like.

Figure 2:
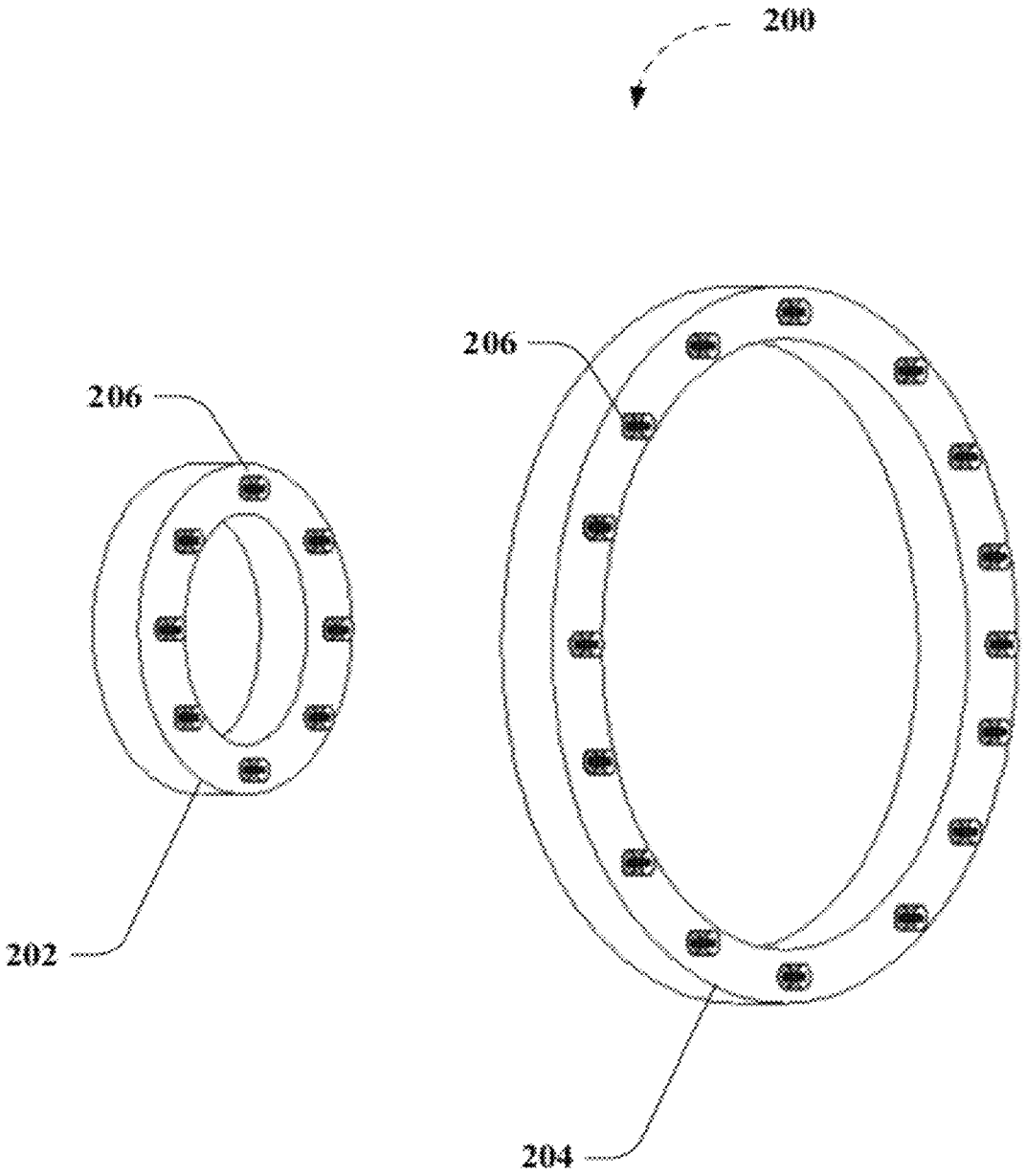
FIG. 2 depicts views of non-limiting ring cavities having various numbers of ports suitable for use with exemplary embodiments of the disclosed subject matter.

In a further example, FIG. 2 depicts views 200 of non-limiting ring cavities 202 and 204 having various numbers of ports 206 suitable for use with exemplary embodiments of the disclosed subject matter. Note that for purposes of illustration and not limitation, the ring cavities are depicts detached from associated power combiner (e.g., power combiner 102 and/or power divider 104, etc.). For instance, as described above, when output power of an amplifier is desired to be increased, nascent limits of the amplifier require that amplifier outputs be combined, leading to the use of a parallel array of input components or devices (e.g., amplifiers, antennas, etc.). This necessitates that ports on the power combiner (e.g., power combiner 102 and/or power divider 104, etc.) be increased to support the array.

However, in contrast to conventional power combiners and/or power dividers, various embodiments of the disclosed subject matter can advantageously increase the number of ports 206 supported by increasing the perimeter of the ring cavity 202/204, relatively independent of the ring cavity cross-section, as further described herein. As a result, various embodiments of the disclosed subject matter can increase the number of ports 206 supported and/or allow higher power output without signal degradation by high order modes associated with conventional power combiners and/or power dividers.

For instance, FIG. 2 depicts that when the number of ports 206 increase from 8 on ring cavities 202 to 16 on ring cavities 204, the cross-section of the ring cavities remains relatively constant, while the perimeter of the ring cavities. That is spacing between adjacent ports 206 and the dimensions describing the cavity surrounding the port 206 probes (not shown) the can remain relatively constant, while the perimeter of the ring can increase to support increasing numbers of ports 206 (e.g., and numbers of devices supported). In other words, to accommodate large numbers of power-dividing ports 206 in the ring cavity, the perimeter of the ring can cavity increase, and the section of the ring cavity can remain relatively constant. As a result, due to appropriate designs of the ring cavities 202/204 of the disclosed subject matter, higher order modes in the ring cavities 202/204 are not propagated. Thus, embodiments of the disclosed subject matter such as ring cavity power-dividing/combining circuits, for example, can be used in UWB active power-combining system and can advantageously support large numbers of active power devices at ports 206 to provide high output power.

Figure 3:
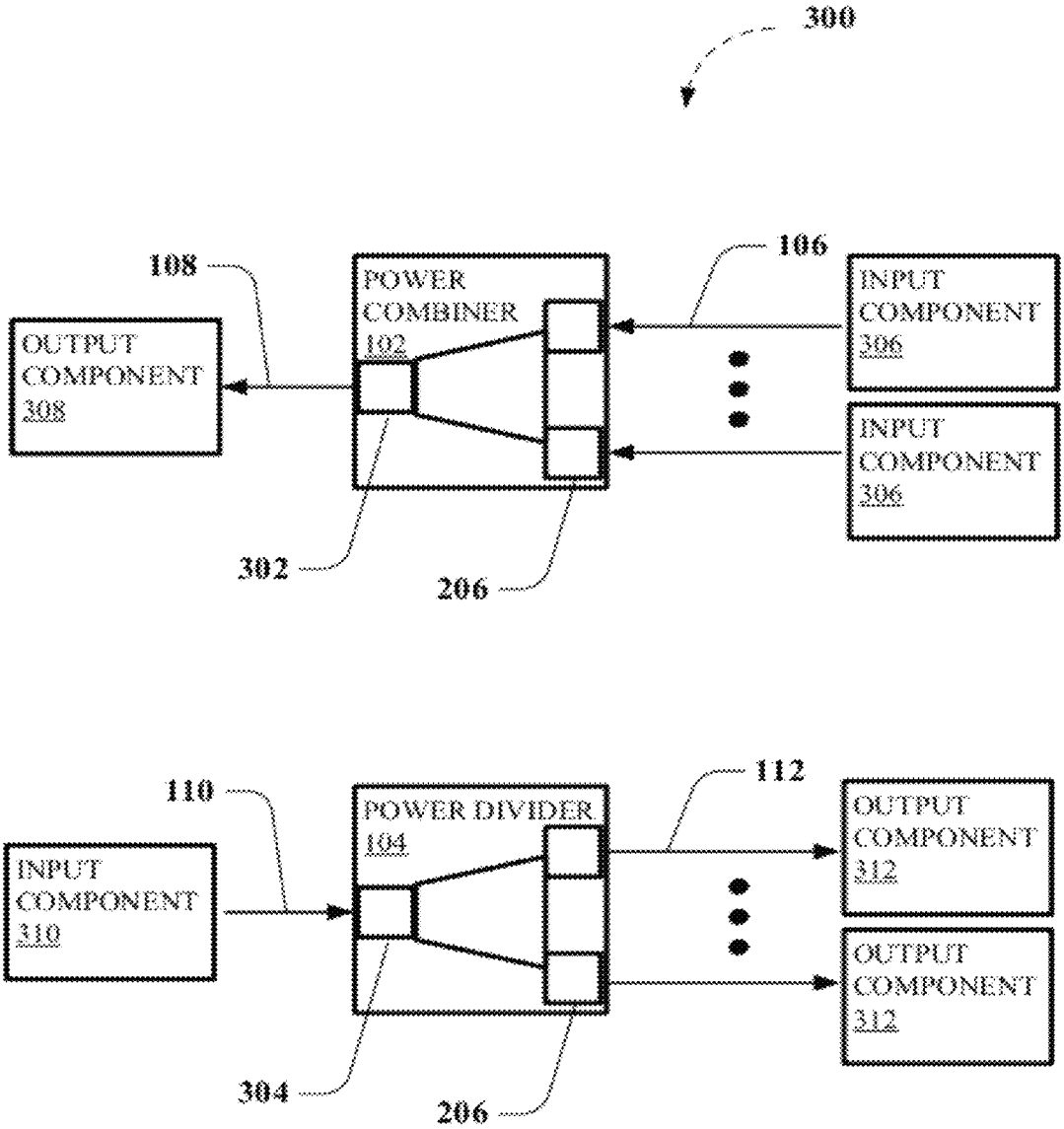
FIG. 3 depicts functional block diagrams of systems suitable for use with exemplary embodiments of the disclosed subject matter.

For instance, FIG. 3 depicts functional block diagrams of systems 300 suitable for use with exemplary embodiments of the disclosed subject matter. As described above regarding FIG. 1, systems 300 can comprise a power combiner 102 and/or a power divider 104 and can further include one or more input signal(s) 106 and an output signal 108 (e.g., for a power combiner 102 configuration, etc.) and/or can further include an input signal 110 and one or more output signal(s) 112 (e.g., for power divider 104 configuration). Accordingly, power combiner 102 and/or a power divider 104 can comprise a port 302/304 opposite ports 206 that can be adapted as an output port 302 or an input port 304 (e.g., similar to that for ports 206, etc.), depending on whether it is configured as a power combiner 102 or a power divider 104, respectively.

Thus, systems 300 can further include one or more input component(s) 306 and an output component 308 (e.g., for a power combiner 102 configuration, etc.). For example, as further described above, power combiner 102 can be employed as a power combiner, for instance, in a transmitter for combining signals (e.g., one or more input signal(s) 106, etc.) from a number of low power devices (e.g., one or more input component(s) 306 etc.) to form a high power signal (e.g., output signal 108, etc.) for transmission through output component 308 (e.g., an antenna, etc.). As a further example, one or more input components 306 (e.g., one or more low or medium output amplifier(s) for amplifying wireless signals, etc.) can be connected in parallel to obtain a desired high power output (e.g., output signal 108, etc.) for transmission of the wireless signals through output component 308 (e.g., an antenna, etc.).

In other non-limiting implementations, systems 300 can further include an input component 310 and one or more output component(s) 312 and (e.g., for a power divider 104 configuration, etc.). For example, power divider 104 can be employed as a power divider in a system 300 for transmitting a signal (e.g., input signal 110 from input component 310, etc.) by exciting an array of e.g., one or more output component(s) 312 (e.g., one or more antenna element(s), etc.) with a signal to be divided into one or more signal(s) (e.g., one or more output signal(s) 112, etc.). As a further example, one or more output component(s) 312 (e.g., one or more antenna elements, etc.) can be connected in parallel to obtain a desired antenna configuration or coverage (e.g., for the one or more output signal(s) 112, etc.). Thus, power divider 104 can be used in systems 300, such as array antenna systems.

Exemplary Non-Limiting Multi-Way Ring Cavity Devices

As described above, with an increasing number of power-dividing ports, the radius of a radial waveguide or conical line will increase, which can cause higher order modes in the radial waveguide or conical line power dividing cavity due to discontinuities, which in turn, can be difficult or impractical to suppress effectively. These effects can be exacerbated when the number of power-dividing ports of power dividers increases to more than about twenty or thirty. As a result, beyond this conventional limitation, the performance of these types of power dividers can deteriorate due to the higher order modes. Accordingly, these conventional waveguide-based power dividers are typically configured with a limited number of power-dividing ports, and thus, the active power-combining systems based on them can only include limited active power devices.

Figure 4:
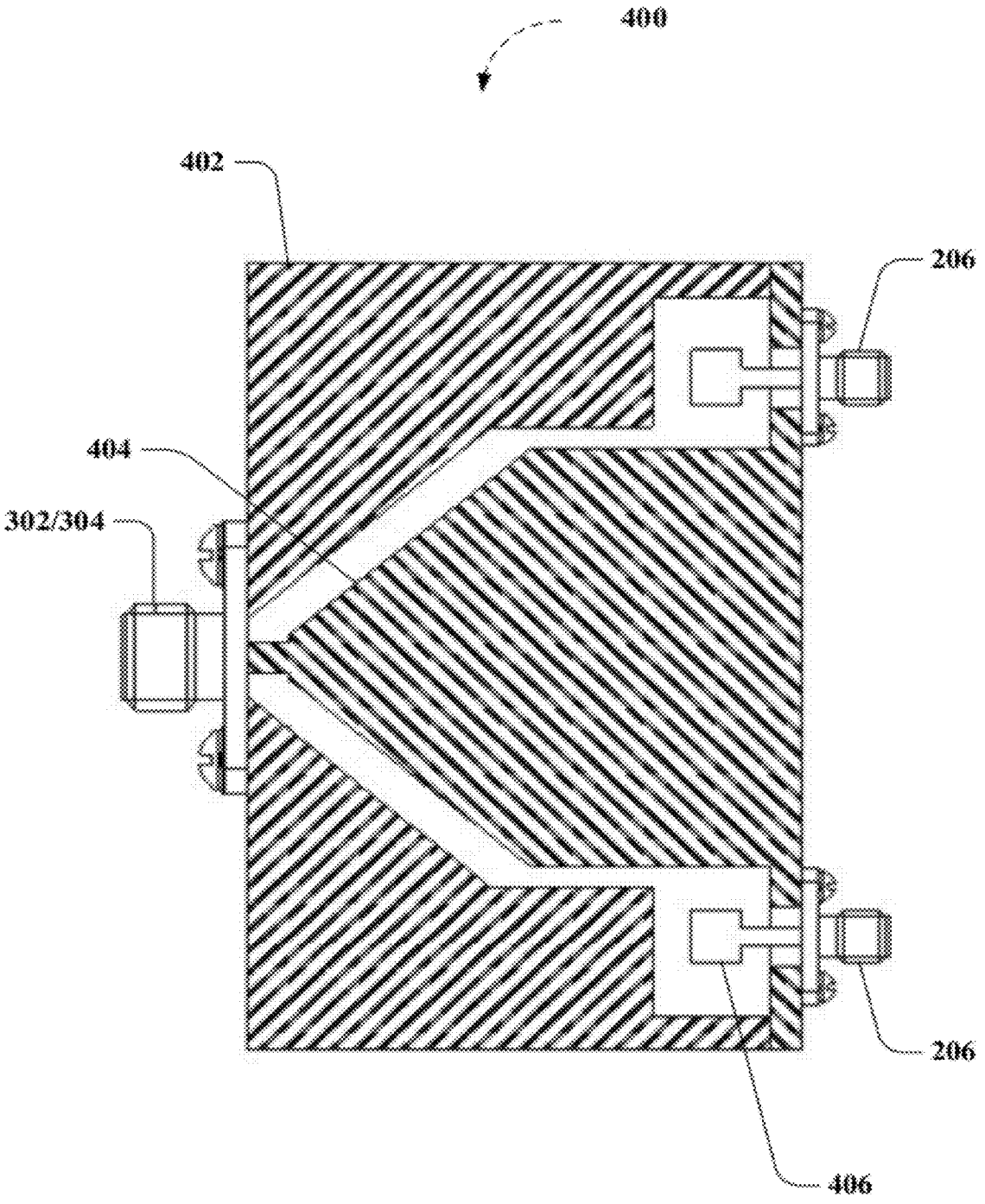
FIG. 4 illustrates a cross-sectional view of an exemplary non-limiting implementation of a ring cavity power divider and/or power combiner illustrating various aspects of the disclosed subject matter.
Figure 5:
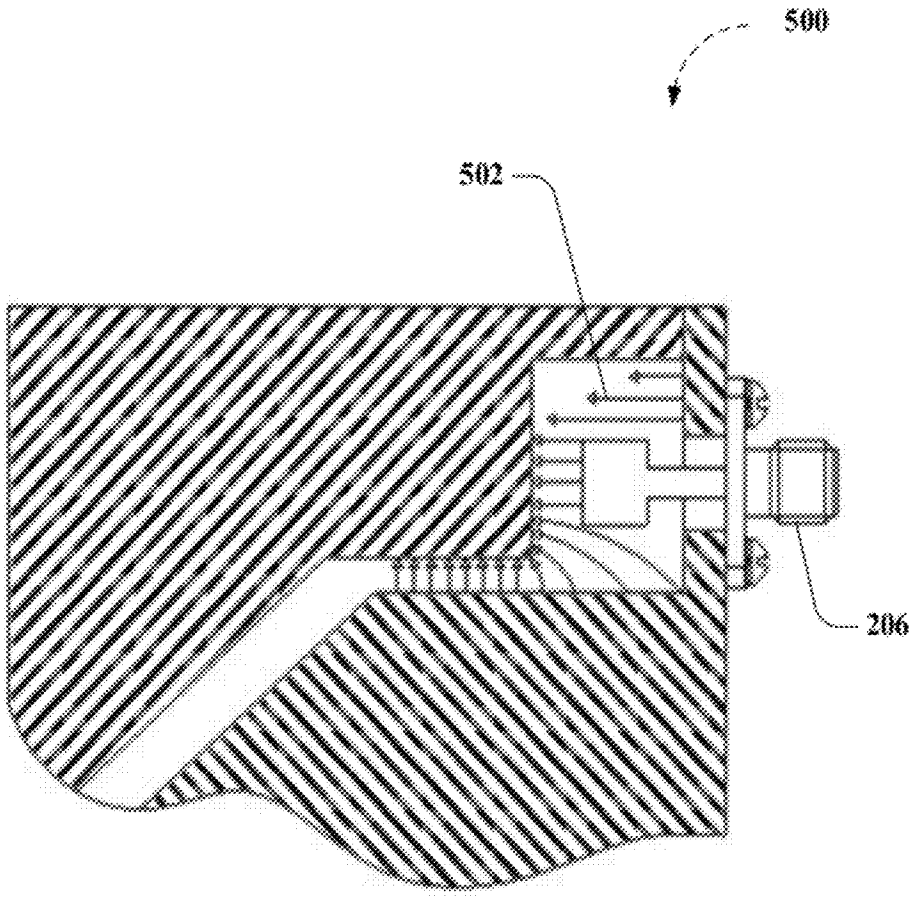
FIG. 5 depicts a further detailed cross-sectional view of an exemplary non-limiting implementation of a ring cavity power divider and/or power combiner illustrating further aspects of the disclosed subject matter in which hypothetical electric field lines are demonstrated flowing through a cross section of the ring cavity.
Figure 6:
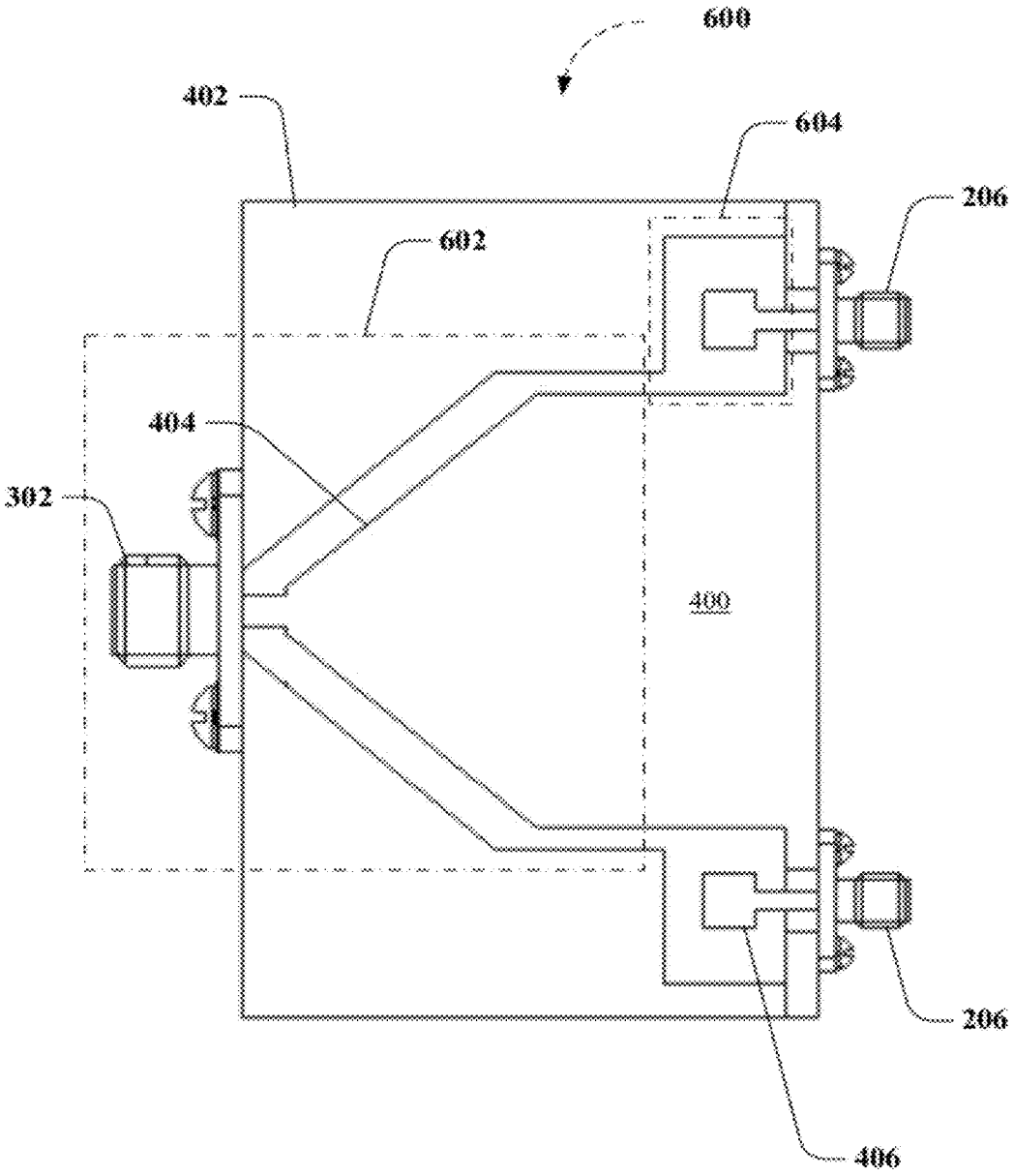
FIG. 6 illustrates a further cross-sectional view demonstrating various aspects of the disclosed subject matter.

Accordingly, in various embodiments, the disclosed subject matter provides multiple-way ring cavity power combiners and power dividers that can overcome the aforementioned deficiencies, as described regarding FIGS. 4-6, for example. Thus, FIG. 4 illustrates a cross-sectional view of an exemplary non-limiting implementation of a ring cavity power divider and/or power combiner (e.g., device 400, etc.) illustrating various aspects of the disclosed subject matter. For instance, device 400 can comprise multiple-way ring cavity power combiners and power dividers that can include a ring cavity formed by a body 402 and coaxial taper 404 (e.g., a matching circuit such as a coaxial taper, a stepped impedance transformer, etc.) that separates a port 302/304 opposite ports 206 that can be adapted as an output port 302 or an input port 304 (e.g., similar to that for ports 206, etc.) from ports 206. In addition, ports 206 can be adapted to locate, position, and/or support parallel probes 406 of the device 400.

FIG. 5 depicts a further detailed cross-sectional view 500 of an exemplary non-limiting implementation of a ring cavity power divider and/or power combiner (e.g., device 400, etc.) illustrating further aspects of the disclosed subject matter in which hypothetical electric field lines 502 are demonstrated flowing through a cross section of the ring cavity from coaxial feed line port 206 and parallel probe 406 to ring cavity formed by body 402 and coaxial taper 404.

FIG. 6 illustrates a further cross-sectional view 600 demonstrating various aspects of the disclosed subject matter. For instance, FIG. 6 depicts device 400 in which phantom lines are used to indicate functional aspects of a coaxial taper feeding port 602 and a cross-section of a ring cavity 604 for exemplary embodiments. Thus, as described above, it can be seen that as the number of ports 206 on device 400 is required to increase, the perimeter of device 400 can increase, but device 400 can be adapted to maintain the ring cavity relatively constant as indicated by cross-section of ring cavity 604. For example, because only the perimeter of the ring cavity 604 increase when the power-dividing ports increase, the cross-section of the ring cavity 604 can keep constant, so that the higher order modes can be prevented from propagating in the ring cavity. Thus, in various embodiments a ring cavity 604 can be employed in an UWB multiple-way power divider, which can effectively suppress higher order modes in power combiners/dividers incorporating large numbers of power-dividing ports.

Thus, referring again to FIG. 4, body 402 and coaxial taper 404 can be comprised of aluminum or one or more suitable alternative(s). It can be seen from FIGS. 4-6 that body 402 and coaxial taper 404 of device 400 can be adapted to cooperate to perform one or more functions comprising forming ring cavity 604, locating, positioning, and/or supporting ports 206 and port 302/304, and so on. To construct a device 400 with large numbers of power-dividing ports (e.g., ports 206) employing ring cavity 604 of the disclosed subject matter, symmetric excitation can be used to implement good amplitude and phase balance of the power-dividing ports (e.g., ports 206). As a result, a coaxial taper feeding port 602 can be adapted to the ring cavity 604 to provide uniform excitation for the multiple-way ring cavity power divider (e.g., device 400), in a particular non-limiting aspect of the disclosed subject matter. Thus, device 400 can facilitate increasing power-dividing ports (e.g., ports 206) greatly without materially impacting performance of device 400.

Referring again to FIG. 4, as described, port 302/304 opposite ports 206 can be adapted as an output port 302 or an input port 304 (e.g., similar to that for ports 206, etc.) from ports 206. In various non-limiting implementations of device 400, ports 206 and port 302/304 can comprise any of a number of suitable connectors that facilitate connecting signal lines and transmitting RF to, from, and/or within the device 400. For example, whereas particular non-limiting implementations described herein can describe one or more of ports 206 and port 302/304 as comprising SubMiniature version A (type-SMA) connectors, type-N connectors, type-K (or 2.92 mm connector), other coaxial connectors, and so on. However, it can be understood that various types of connectors can be substituted for other types, so long as the performance specifications are adequate to the application, without limiting the scope of the disclosed subject matter.

In addition, ports 206 can be adapted to locate, position, and/or support parallel probes 406 of the device 400. For instance, as further described herein, parallel probes 406 can comprise any of a number of probe types (e.g., coaxial probes, microstrip probes, etc.) suitable to couple RF signals to the ring cavity (e.g., ring cavity 604). Thus, ports 206 can comprise connectors, as described herein, and/or parallel probes 406 formed integrally with the connectors or otherwise attachable to connectors, such that the parallel probes 406 can be positioned appropriately within ring cavity 406. Moreover, as further described herein, parallel probes 406 can comprise any of a number of suitable alternative probe technologies (e.g., coupling probes, coaxial probes, microstrip probes, etc.) adapted to couple RF signals to or from ring cavity 604 to from or to ports 206.

Thus, when the various disclosed embodiments are compared with existing technologies, the disclosed subject matter can advantageously provide practically unlimited numbers (e.g., more than about thirty, etc.) of power-dividing ports (e.g., ports 206), and thus practically unlimited numbers of supported devices (e.g., one or more input component(s) 304, one or more output component(s) 312, etc.). In addition, embodiments of the disclosed subject matter can suppress higher order modes effectively, while preserving UWB performance characteristics, and can demonstrate fractional bandwidth greater than about 110%. Moreover, as a further advantage, various disclosed embodiments can provide amplitude and phase balance of the power-dividing ports, for example, across the UWB band. Accordingly, the various non-limiting implementations as described herein can overcome the demonstrated deficiencies of conventional power dividers/combiners while demonstrating excellent electrical performance.

Figure 7:
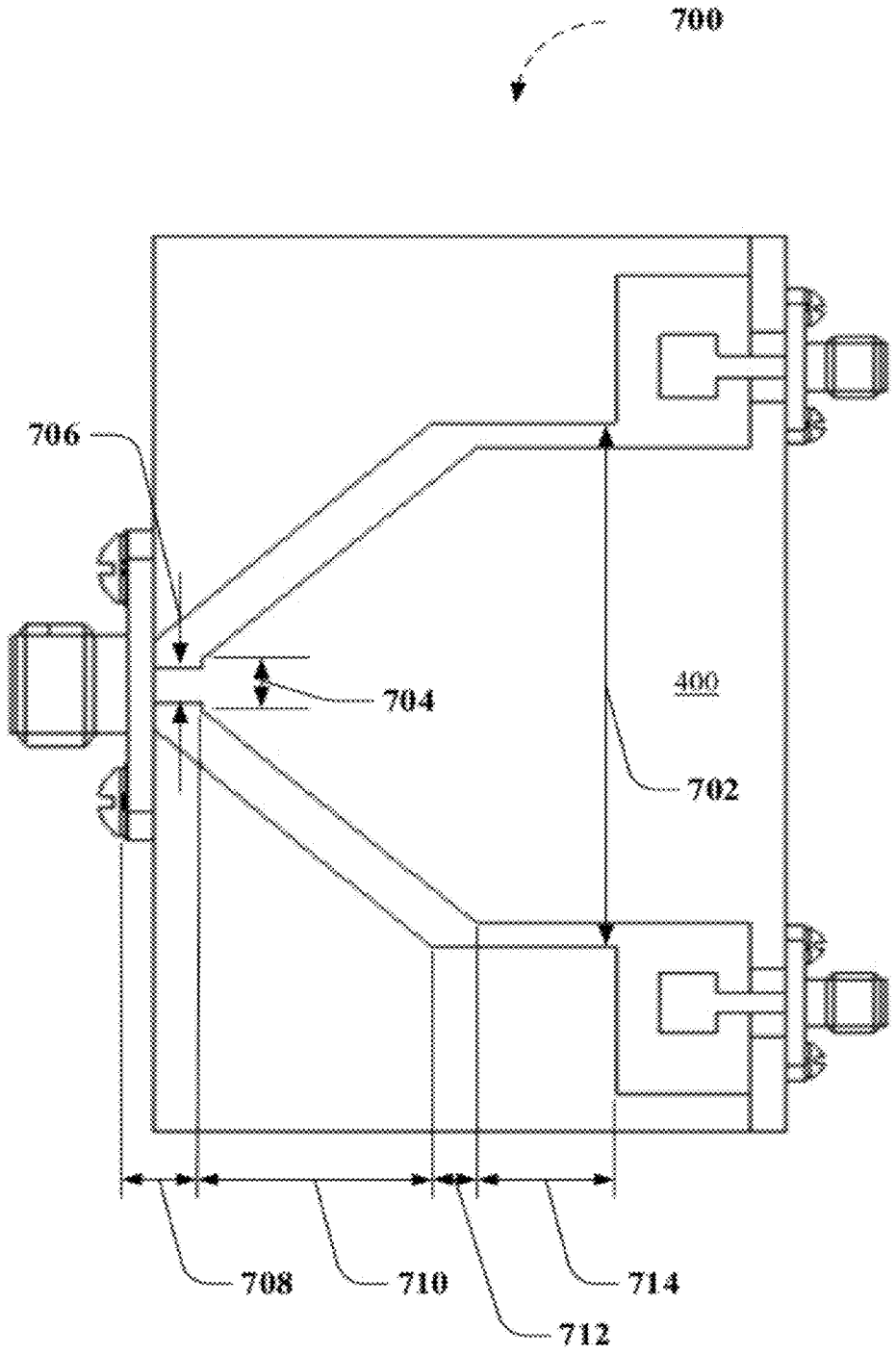
FIGS. 7-8 depict side views of exemplary non-limiting implementations of a ring cavity power divider and/or power combiner illustrating still further exemplary aspects of the disclosed subject matter.
Figure 8:
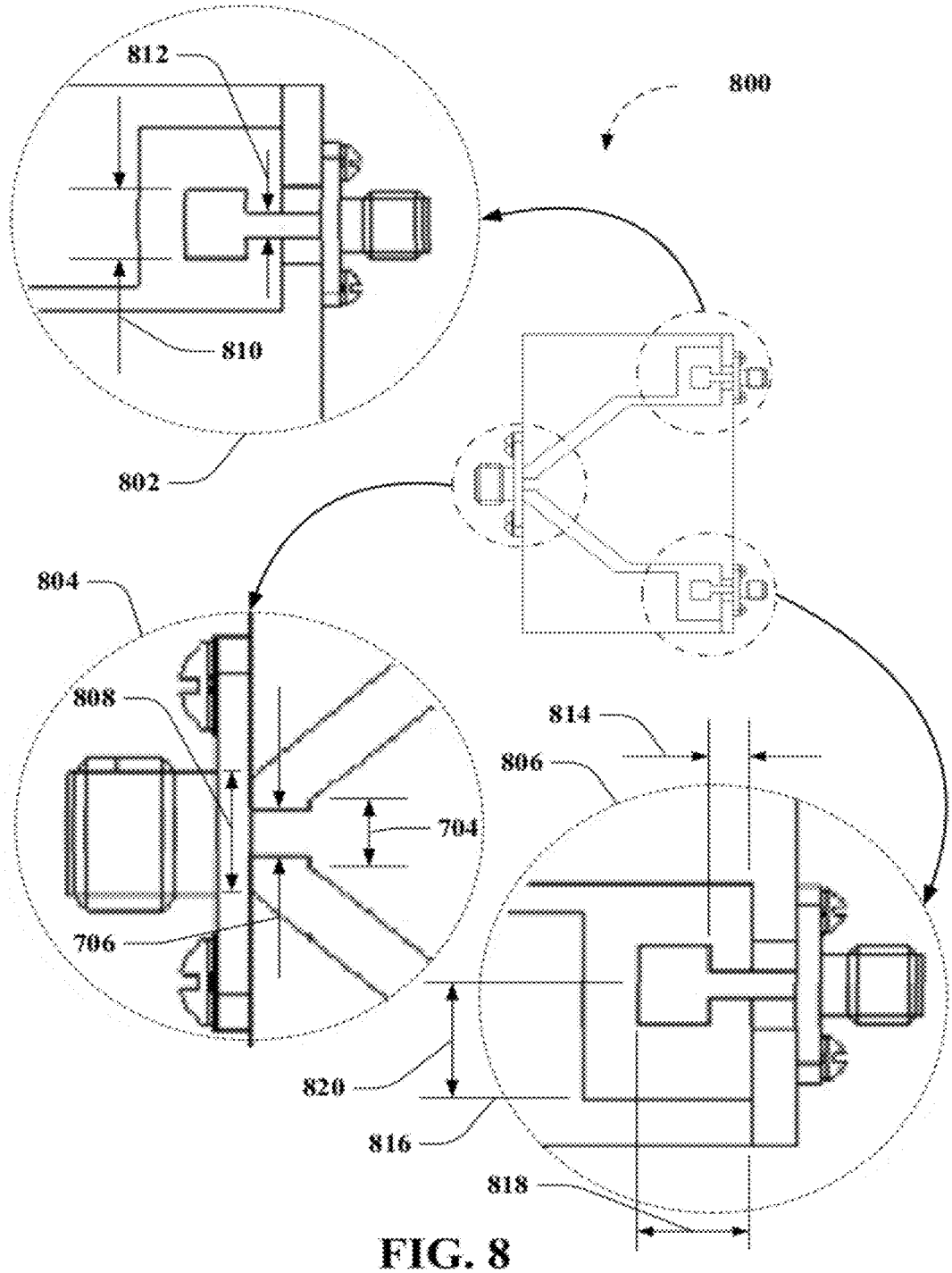

FIGS. 7-8 depict side views of exemplary non-limiting implementations of a ring cavity power divider and/or power combiner (e.g., device 400) illustrating still further exemplary aspects of the disclosed subject matter. For instance, FIGS. 7-8 depict various dimensions of exemplary non-limiting device 400 and portions thereof such as coaxial taper 404 in FIG. 7 and parallel probes 406, ports 206, port 302/304, in insets 802, 804, and 806 of FIG. 8. Note that while various dimensions are indicated in FIGS. 7-8, it can be understood that the indications are made for illustration and not limitation. For instance, it should be further understood that the indication of a particular dimension does not connote particular importance or indicate that such dimension is a critical feature or characteristics of the various non-limiting implementations. Likewise, the lack of an indication in FIGS. 7-8 does not connote that the dimension or characteristic is immaterial. Rather, the various indications are merely meant to provide a general understanding suitable to enable one skilled in the relevant art to make and use various embodiments of the disclosed subject matter, without undue experimentation. It can be further understood that various other details, which may be required to enable the reproduction of the various disclosed embodiments, and that may be known to one skilled in the relevant art may be omitted for clarity.

Thus, referring again to FIGS. 4-8, exemplary embodiments of the disclosed subject matter can comprise a power combiner 102 comprising a port 302/304 opposite ports 206 that can be adapted as an output port 302. In turn, output port 302 can comprise a type-N connector or suitable replacement connector. Exemplary power combiner 102 can further comprise a matching and transition circuit (e.g., an impedance matching and/or transition circuit, and so on, or portions thereof, etc.) from output port 302 (e.g., a type-N connector to ring cavity as output port 302, etc.) to the ring cavity 604. In addition, exemplary power combiner 102 can further comprise parallel probes 406 (e.g., such as coupling probes, coaxial probes, microstrip probes, etc.), where each of the parallel probes 406 is located, positioned, and/or supported by ports 206, respectively, that can function as inlet ports. In turn, ports 406 can comprise SubMiniature version A (type-SMA) connectors or suitable replacement connectors. Accordingly, exemplary power combiner 102 can transmit multiple input RF signals (e.g., one or more input signal(s) 106, etc.) through multiple SMA connectors (e.g., ports 206), can combine all of the input RF signals in the ring cavity (e.g., ring cavity 604), and can then output the combined signal through the type-N connector (e.g., output port 302) as an output signal (e.g., output signal 108, etc.).

As a result, in exemplary embodiments of power combiner 102, a type-N connector can function as an output port (e.g., output port 302), which can connect to a terminator (not shown) (e.g., output component 308, etc.) to which the combined signal (e.g., output signal 108, etc.) can be transmitted. Moreover, in exemplary embodiments of power combiner 102, the type-SMA connectors can function as input ports (e.g., ports 206), which can transmit RF signals (e.g., one or more input signal(s) 106, etc.) into ring cavity (e.g., ring cavity 604) through the one or more parallel probe(s) (e.g., parallel probes 406).

According to a further non-limiting aspect, exemplary embodiments of power combiner 102 can comprise a matching circuit, which can further include a coaxial taper (e.g., coaxial taper feeding port 602, taper feed 404, etc.), a stepped impedance transformer, and or other components or subcomponents thereof, any of which can function to facilitate providing smooth impedance matching from the ring cavity (e.g., ring cavity 604) to the type-N connector (e.g., output port 302) and uniform excitation for the multiple-way ring cavity power combiner as described herein. For instance, as described above regarding FIGS. 4 and 6, a coaxial taper (e.g., coaxial taper feeding port 602, taper feed 404, etc.), a stepped impedance transformer, and so on can connect with type-N connector (e.g., output port 302) and ring cavity (e.g., ring cavity 604), and as can be seen in FIG. 4, for example the shape of the taper feed 404 can increase from type-N connector (e.g., output port 302) to the ring cavity (e.g., ring cavity 604), more or less in a continuous taper. As a further non-limiting advantage, embodiments of the disclosed subject matter can employ a stepped impedance transformer such as a multiple-section coaxial stepped impedance transformer to obtain perfect or nearly perfect impedance matching.

As further described with regard to FIGS. 4-8, for instance, the ring cavity (e.g., ring cavity 604) can connect with coaxial taper 404 to provide uniform excitation in exemplary embodiments of power combiner 102. In a further non-limiting aspect, coaxial probes (e.g., parallel probes 406) can couple RF signals from type-SMA connectors (e.g., ports 206) to ring cavity (e.g., ring cavity 604). As a result, in various embodiments, RF signals can be combined in the ring cavity (e.g., ring cavity 604) as depicted in FIG. 5, through the parallel probes 406 (e.g., coupling probes, coaxial probes, microstrip probes, etc.) adapted to couple RF signals to the ring cavity (e.g., ring cavity 604). In still another non-limiting implementation, the length of the coaxial probes (e.g., parallel probes 406) can be tuned for a predetermined application. For instance, for a given application having a wavelength at central frequency, $\lambda_g$, exemplary embodiments of power combiner 102 can comprise parallel probes 406 selected such that dimension 818 of FIG. 8 (e.g., probe length) can be about $\lambda_g/4$. In yet other non-limiting implementations, coaxial probes (e.g., parallel probes 406) can be equally spaced about the ring cavity, and/or can be identical in shape and/or size, or nearly so (e.g., nearly identical given acknowledge engineering tolerances, acceptance criteria, etc.).

Again, referring to FIGS. 4-8, exemplary embodiments of the disclosed subject matter can comprise a power divider 104 comprising a port 302/304 opposite ports 206 that can be adapted as an input port 304. In turn, input port 304 can comprise a type-N connector or suitable replacement connector. Exemplary power divider 104 can further comprise a matching and transition circuit (e.g., an impedance matching and/or transition circuit, and so on, or portions thereof, etc.) from input port 304 (e.g., a type-N connector to ring cavity as input port 304, etc.) to the ring cavity 604. In addition, exemplary power divider 104 can further comprise parallel probes 406 (e.g., such as coupling probes, coaxial probes, microstrip probes, etc.), where each of the parallel probes 406 is located, positioned, and/or supported by ports 206, respectively, that can function as outlet ports. In turn, ports 406 can comprise type-SMA connectors or suitable replacement connectors. Accordingly, exemplary power divider 104 can transmit an input RF signal (e.g., input signal 110, etc.) through the ring cavity (e.g., ring cavity 604) to multiple parallel probes 406 in the ring cavity and to multiple SMA connectors (e.g., ports 206) as output signals (e.g., one or more output signal(s) 112, etc.).

As a result, in exemplary embodiments of power divider 104, a type-N connector can function as an input port (e.g., input port 304), whereas multiple SMA connectors (e.g., ports 206) can function as output ports and can connect to terminators, power amplifiers, antennas, or other circuits (not shown) (e.g., one or more output component(s) 312, etc.) to which the divided signal (e.g., one or more output signal(s) 112, etc.) can be transmitted. Thus, exemplary embodiments of power divider 104 can transmit an RF signal (e.g., input signal 110, etc.) into ring cavity (e.g., ring cavity 604) through the coaxial taper (e.g., coaxial taper feeding port 602, taper feed 404, etc.).

According to a further non-limiting aspect, exemplary embodiments of power divider 104 can comprise a matching circuit, which can further include a coaxial taper (e.g., coaxial taper feeding port 602, taper feed 404, etc.), a stepped impedance transformer, and or other components or subcomponents thereof, any of which can function to facilitate providing smooth impedance matching from the type-N connector (e.g., input port 304) to the ring cavity (e.g., ring cavity 604) and uniform excitation for the multiple-way ring cavity power divider as described herein. For instance, as described above regarding FIGS. 4 and 6, a coaxial taper (e.g., coaxial taper feeding port 602, taper feed 404, etc.), a stepped impedance transformer, and so on can connect with type-N connector (e.g., input port 304) and ring cavity (e.g., ring cavity 604), and as can be seen in FIG. 4, for example the shape of the taper feed 404 can increase from type-N connector (e.g., input port 304) to the ring cavity (e.g., ring cavity 604), more or less in a continuous taper. As a further non-limiting advantage, embodiments of the disclosed subject matter can employ a stepped impedance transformer such as a multiple-section coaxial stepped impedance transformer to obtain perfect or nearly perfect impedance matching.

As further described with regard to FIGS. 4-8, for instance, the ring cavity (e.g., ring cavity 604) can be connected with coaxial taper 404 to provide uniform excitation in exemplary embodiments of power divider 104. In a further non-limiting aspect, coaxial probes (e.g., parallel probes 406) can couple RF signals from ring cavity (e.g., ring cavity 604) to type-SMA connectors (e.g., ports 206). As a result, in various embodiments, RF signals can be divided in the ring cavity (e.g., ring cavity 604) as depicted in FIG. 5, through the parallel probes 406 (e.g., coupling probes, coaxial probes, microstrip probes, etc.). In still another non-limiting implementation, the length of the coaxial probes (e.g., parallel probes 406) can be tuned for a predetermined application. For instance, for a given application having a wavelength at central frequency, $\lambda_g$, exemplary embodiments of power divider 104 can comprise parallel probes 406 selected such that dimension 818 of FIG. 8 (e.g., probe length) can be about $\lambda_g/4$. In yet other non-limiting implementations, coaxial probes (e.g., parallel probes 406) can be equally spaced about the ring cavity, and/or can be identical in shape and/or size, or nearly so (e.g., nearly identical given acknowledge engineering tolerances, acceptance criteria, etc.).

Accordingly, in various non-limiting implementations, the disclosed subject matter provides exemplary devices (e.g., device 400, etc.) comprising a first port (e.g., port 302/304 opposite ports 206 that can be adapted as an output port 302 or an input port 304, and a ring cavity (e.g., ring cavity 604) comprising one or more parallel probe(s) (e.g., one or more parallel probe(s) 406) associated with one or more second port(s) (e.g., one or more port(s) 206). In addition, exemplary devices can further comprise, an impedance matching circuit (e.g., taper feed 404, coaxial taper feeding port, stepped impedance transformer, coaxial stepped impedance transformer, etc.) adapted to match impedance between the first port (e.g., port 302/304) and the ring cavity (e.g., ring cavity 604).

As further described herein, the first port (e.g., port 302/304) and/or the one or more second port(s) (e.g., one or more port(s) 206) can comprise one or more of a type-N connector, a subminiature version A (type-SMA) connector, a coaxial connector, and/or other suitable connectors. Moreover, in further non-limiting implementations, the one or more parallel probe(s) (e.g., one or more parallel probe(s) 406) can also comprise one or more of coaxial probes, microstrip probes, or other probes suitable for coupling the RF between the one or more second ports (e.g., one or more port(s) 206) and the ring cavity (e.g., ring cavity 604). In addition, the one or more parallel probe(s) can be further configured with equal spacing around the ring cavity, identical shape, identical size, and/or probe length (e.g., dimension 818 of FIG. 8) defined by $\lambda_g/4$, where $\lambda_g$ is a wavelength at central frequency for a predetermined application of the exemplary device as further described herein. For instance, as described above for an UWB device, the one or more parallel probes (e.g., one or more parallel probe(s) 406) can be configured with probe length (e.g., dimension 818 of FIG. 8) defined by $\lambda_g/4$, where $\lambda_g$ is the wavelength at central frequency for the predetermined application of the device, and where the central frequency for the predetermined application lies in a frequency range from 3.1 to 10.6 GigaHertz (GHz).

Thus, in various non-limiting aspects, exemplary devices can be configured with the first port (e.g., port 302/304) as an input port (e.g., input port 304), the one or more second port(s) (e.g., one or more port(s) 206) as one or more output port(s), and the device configured as a power divider (e.g., power divider 104). In other non-limiting aspects, exemplary devices can be configured with the first port (e.g., port 302/304) as an output port (e.g., output port 302), the one or more second port(s) (e.g., one or more port(s) 206) as one or more input port(s), and the device configured as a power divider (e.g., power divider 104).

In further non-limiting implementations, exemplary power dividers (e.g., device 400) can comprise an input port (e.g., input port 304) and one or more output port(s) (e.g., one or more port(s) 206). In addition, the exemplary power dividers can comprise a means for dividing an RF signal in a ring cavity between the input port (e.g., input port 304) and the one or more output port(s) (e.g., one or more port(s) 206). For instance, the means for dividing an RF signal can comprise one or more of the ring cavity (e.g., ring cavity 604) in conjunction with the one or more parallel probe(s) 406, and/or the impedance matching or transition circuit as described herein.

In still other non-limiting implementations, exemplary power combiners (e.g., device 400) can comprise one or more input connector(s) (e.g., at one or more port(s) 206) for accepting one or more input RF signal(s) and an output connector (e.g., at output port 302). In a further non-limiting aspect, exemplary power combiners can further comprise a means for combining the one or more input RF signal(s) in a ring cavity between the one or more input connector(s) and the output connector. For example, the means for combining an RF signal can comprise one or more of the ring cavity (e.g., ring cavity 604) in conjunction with the one or more parallel probe(s) 406, and/or the impedance matching or transition circuit as described herein.

Figure 9:
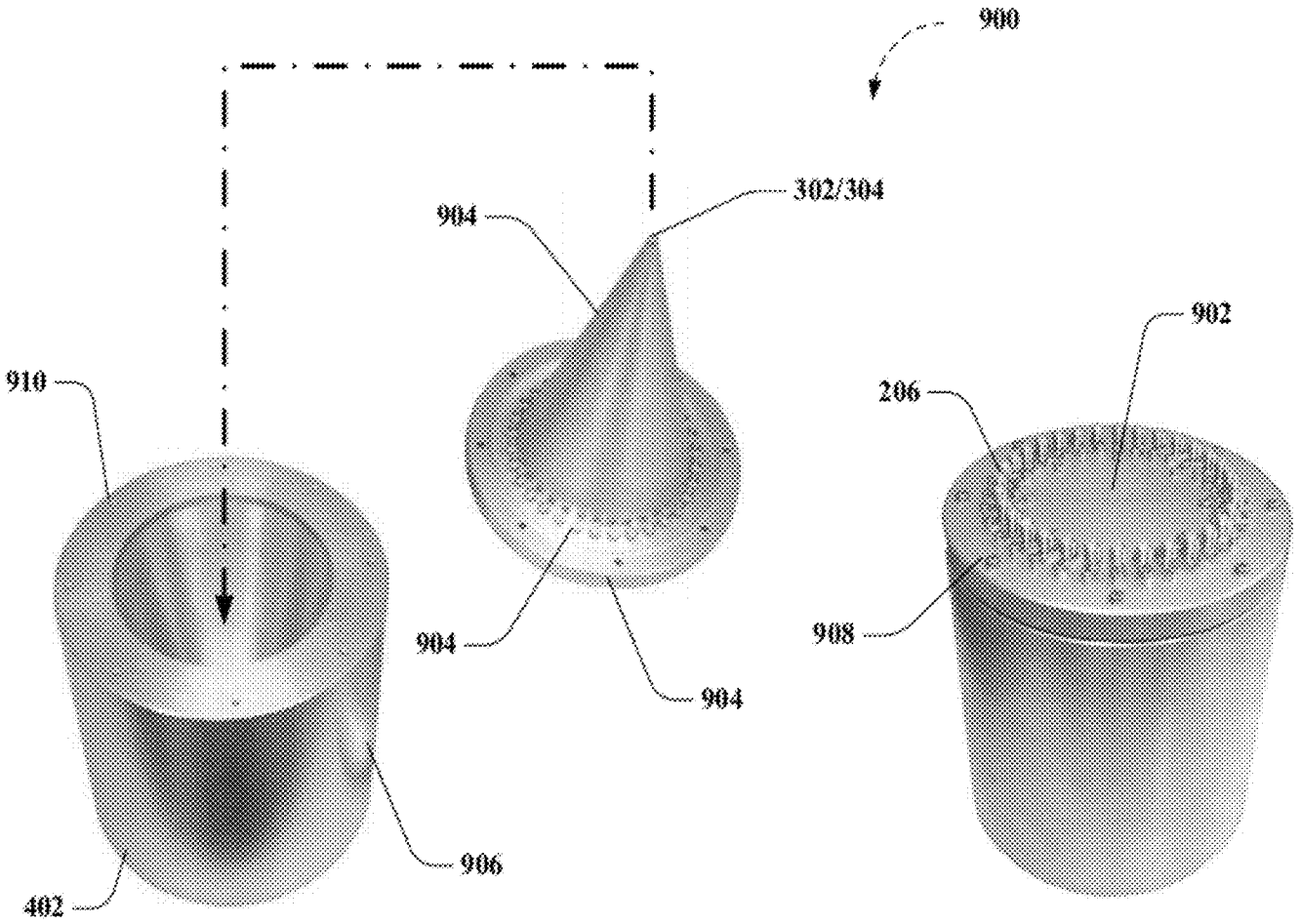
FIGS. 9-10 depict an exemplary implementation of a ring cavity power divider and/or power combiner in accordance with various non-limiting aspects of the disclosed subject matter.
Figure 10:
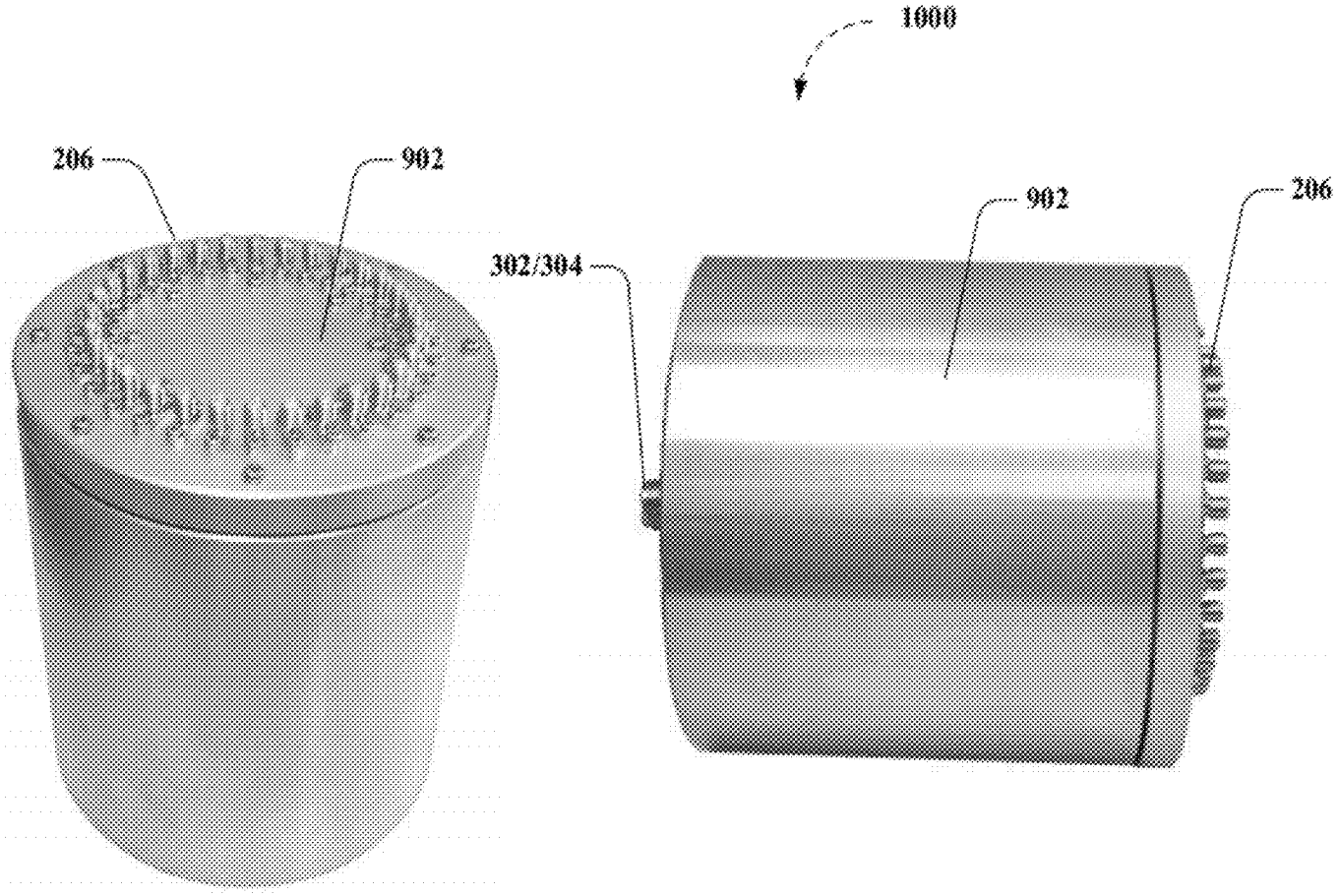

FIGS. 9-10 depict an exemplary implementation 900 of a fabricated 32-way ring cavity power divider 902, component subassemblies 904 and 906 in accordance with various non-limiting aspects of the disclosed subject matter. For example, subassembly 904 can be seen in FIG. 9 to comprise coaxial taper feeding port 602 (e.g., comprising port 302/304, coaxial taper 404, etc.) and parallel probes 406 extending from ports 206. Subassembly 906 can be seen in FIG. 9 to comprise body 402 that can comprise the corresponding conical section adapted to accept coaxial taper feeding port 602, and can further comprise structures complementary to subassembly 904 that, when subassemblies 904 and 906 are assembled form the ring cavity 604. FIGS. 9 and 10 further depict means to assemble the subassembly 904 to the subassembly 906, which in the illustrative non-limiting implementations can comprise threaded fasteners 908 and corresponding threaded holes or nuts 910 adapted to accept threaded fasteners 908. FIG. 10 depicts further views 1000 of a fabricated 32-way ring cavity power divider 902 in accordance with various non-limiting aspects of the disclosed subject matter. It should be noted that while the various figures of the disclosed subject matter depict particular non-limiting embodiments, configurations, structures, and so on for ease of illustration, the disclosed subject matter is not so limited Exemplary Simulated and Measured Performance Various non-limiting embodiments of the disclosed subject matter can advantageously provide wide bandwidth, practically unlimited capacity for power-dividing ports (e.g., ports 206) and supported devices (e.g., one or more input component(s) 304, one or more output component(s) 312, etc.), excellent input impedance matching, low insertion loss, good balance of amplitude and phase at output ports, and flat group delay within UWB frequency ranges of interest. As described, an exemplary 32-way power divider (e.g., 32-way ring cavity power divider 902) can be fabricated and the device simulated to develop a simulation model and check it for correspondence with the device. Accordingly, an approximated equivalent-circuit model of the exemplary device (e.g., 32-way ring cavity power divider 902) can facilitate analyzing structural parameters and electrical performance. In addition, an overall circuit model of the exemplary device (e.g., 32-way ring cavity power divider 902) can be employed as expected to facilitate efficient implementation of embodiments of the disclosed subject matter and design of corresponding systems. Moreover, simplified simulation models can facilitate rapid simulation. As a result, after designing and optimizing, the exemplary device (e.g., 32-way ring cavity power divider 902) can be shown to provide reasonable agreement between simulated and measured results.

Figure 11:
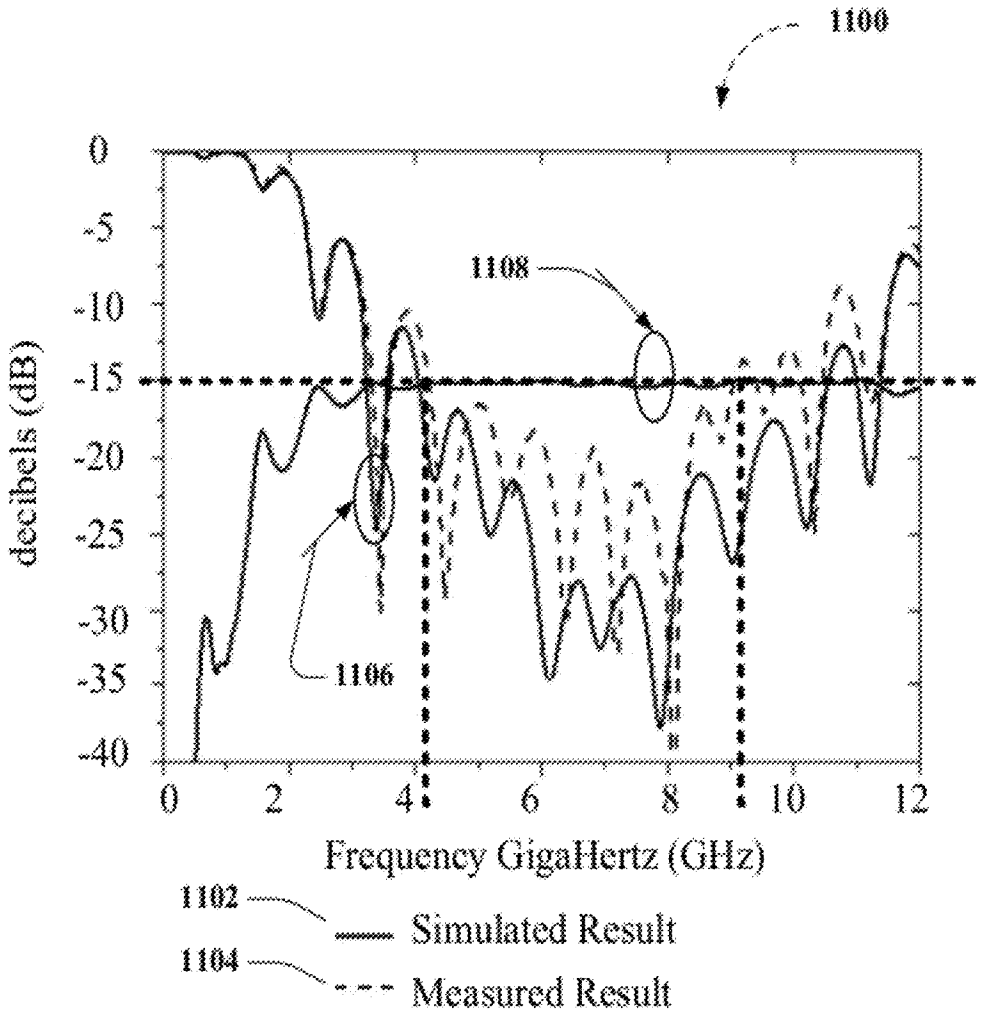
FIGS. 11-14 demonstrate various non-limiting measured and simulated performance characteristics for an exemplary implementation of a ring cavity power divider and/or power combiner as described herein.

For example, FIGS. 11-14 demonstrate various non-limiting measured and simulated performance characteristics for an exemplary implementation of a ring cavity power divider and/or power combiner as described herein. For instance, FIG. 11 demonstrates UWB simulated 1102 and measured 1104 performance for a particular non-limiting implementation as well as S-parameters (e.g., S11 1106 and S21 1108) for the exemplary 32-way power divider (e.g., 32-way ring cavity power divider 902). For instance, note that for the frequency range corresponding to the UWB band frequency range, return loss can be greater than 10 decibels (dB) (and can be greater than 15 dB from 4.2 to 9.2 GHz), while insertion loss can be less than 0.8 dB (the 15 dB power division loss for a 32-way divider is not included), whereas the 15-dB return loss bandwidth can be seen as 5 GHz (4.2-9.2 GHz) as can be seen in FIG. 11.

Figure 12:
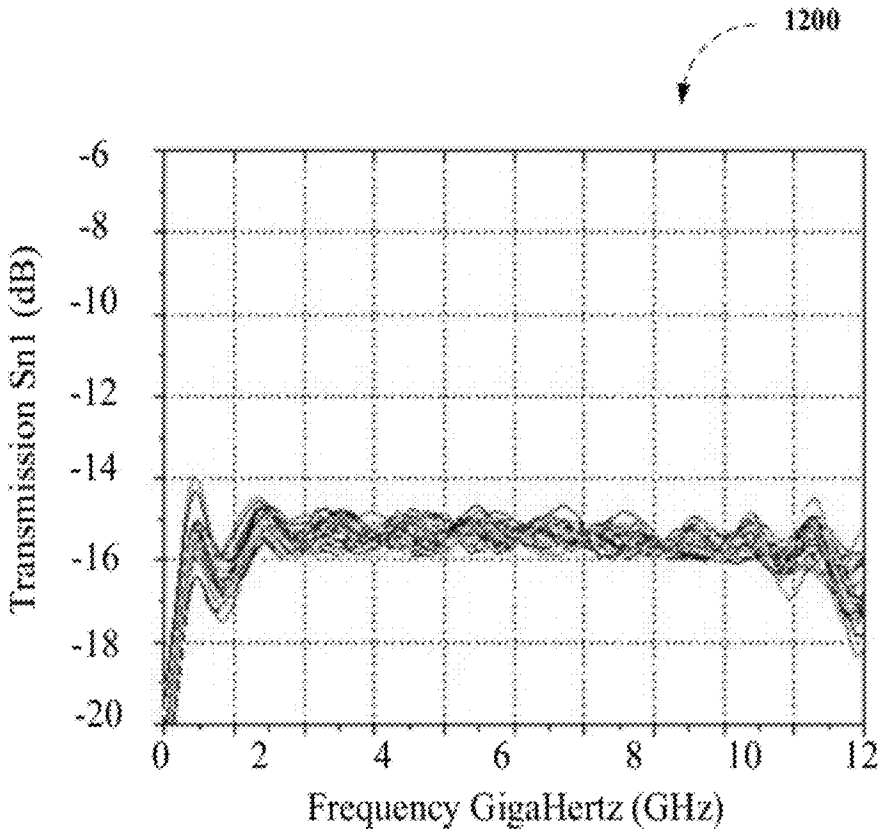
Figure 13:
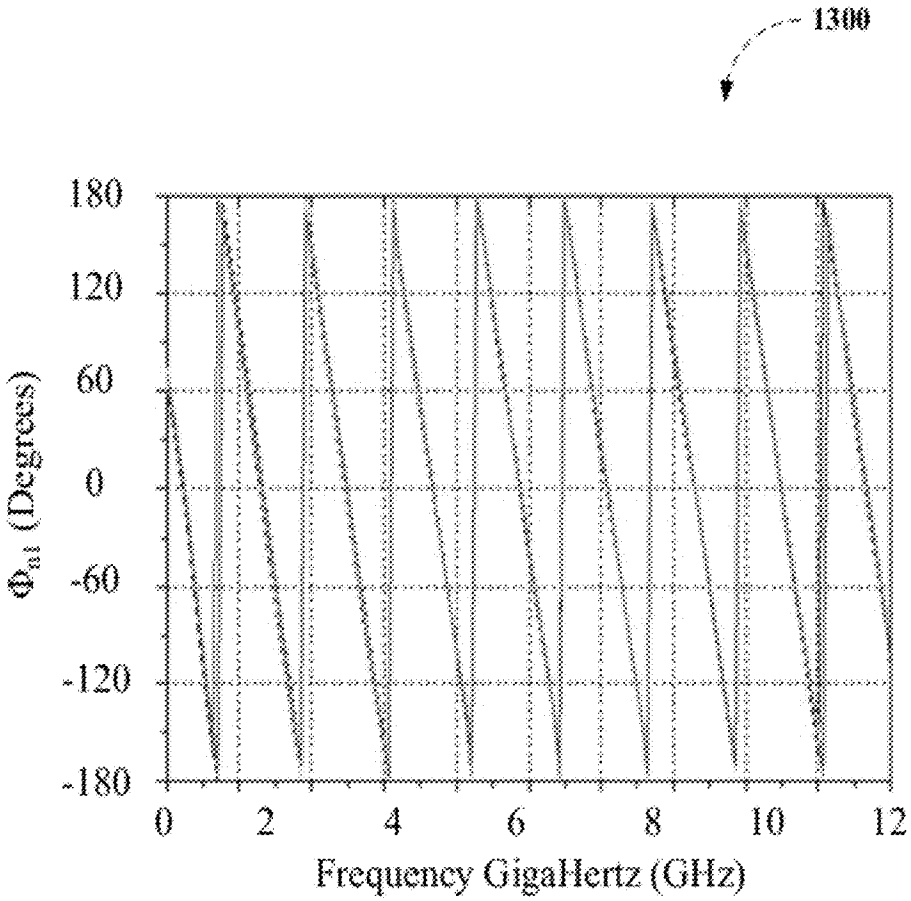
Figure 14:
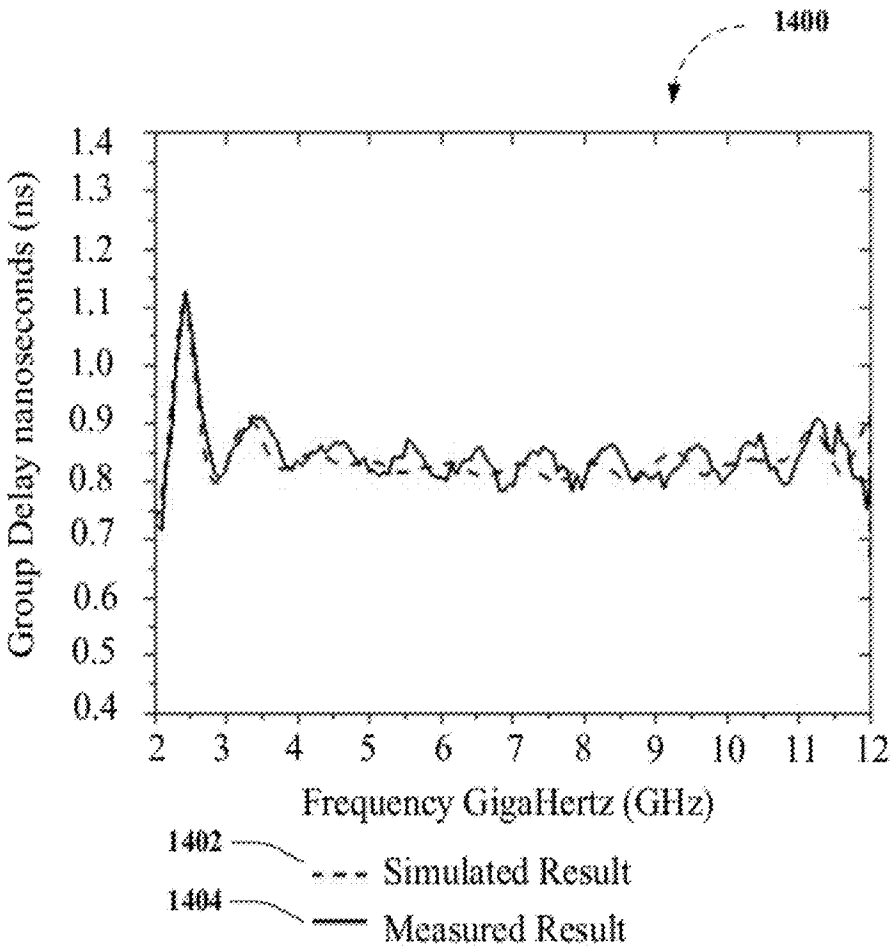

As a further example, particular non-limiting implementations of the 32-way power divider (e.g., 32-way ring cavity power divider 902) demonstrate low loss and good balance of amplitude and phase in FIGS. 12-13. For instance, for measured transmission coefficients (n=2; 3; . . . ; 33), FIG. 12 demonstrates the amplitude matching (e.g., ±0.7 dB) and FIG. 13 demonstrates the phase matching (e.g., ±5°), which are well suited to UWB operation. In yet another example, particular non-limiting implementations of the 32-way power divider (e.g., 32-way ring cavity power divider 902) demonstrate excellent group delay of 0.81-0.91 nanoseconds (ns) in the frequency range corresponding to the UWB band as depicted in FIG. 14. As can be seen in FIGS. 11-14, particular non-limiting implementations of the disclosed subject matter (e.g., 32-way ring cavity power divider 902) demonstrate reasonable agreement between simulated and measured results.

Figure 15:
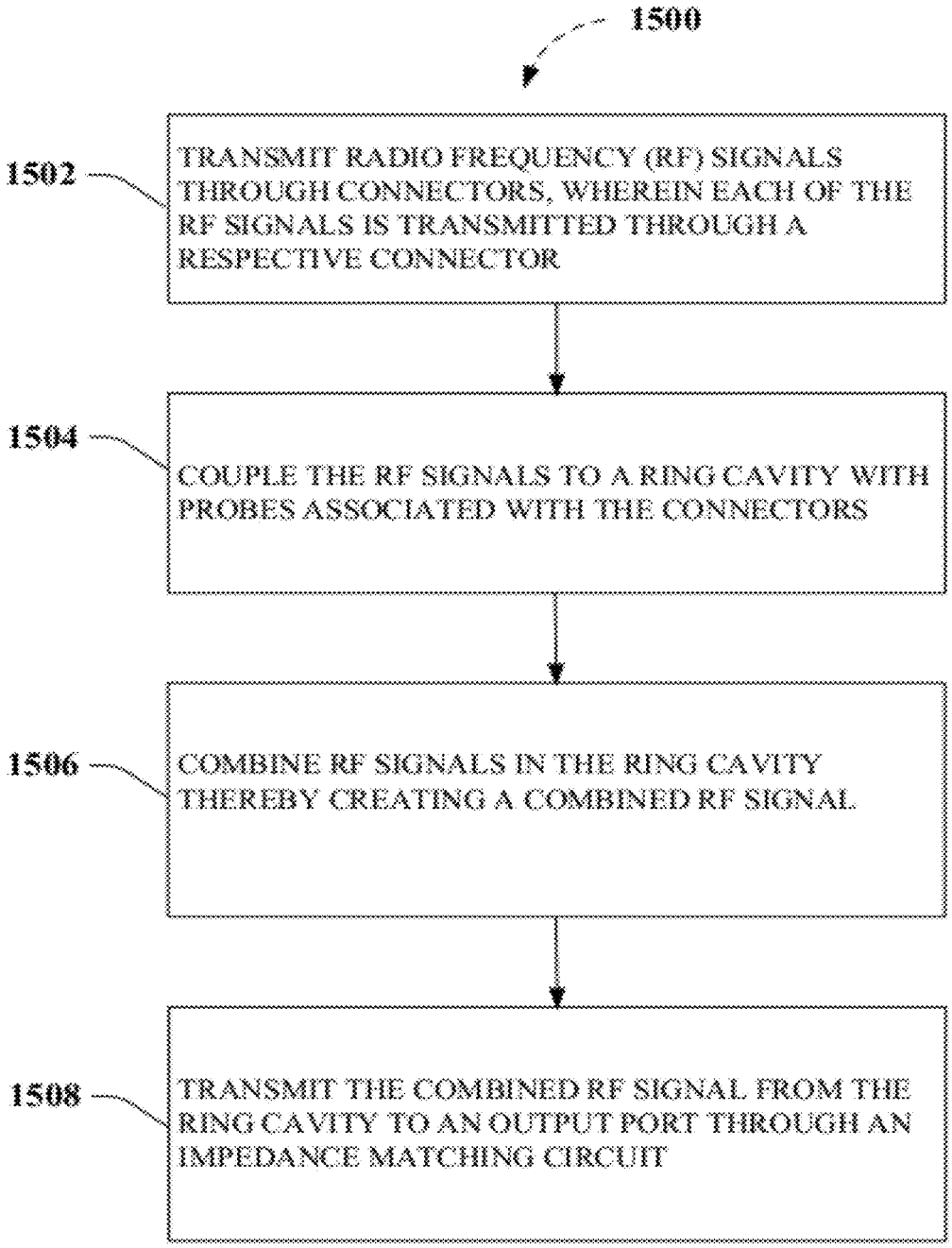
FIGS. 15-16 depict a block diagram demonstrating methods in accordance with aspects of the disclosed subject matter.
Figure 16:
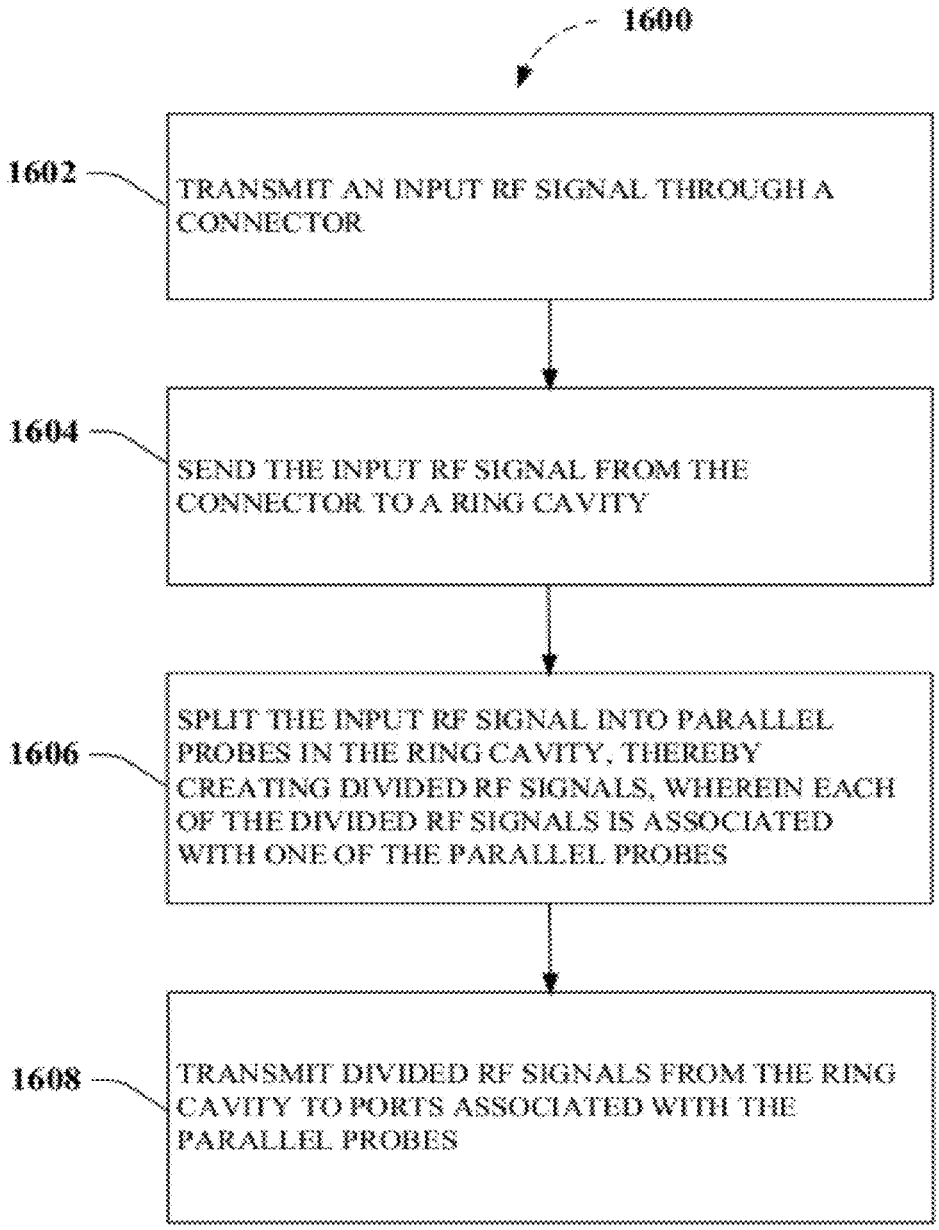

In view of the structures and devices described supra, methods that can be implemented in accordance with the disclosed subject matter will be better appreciated with reference to the flowcharts of FIGS. 15-16. While, for purposes of simplicity of explanation, the methods are shown and described as a series of blocks, it is to be understood and appreciated that such illustrations or corresponding descriptions are not limited by the order of the blocks, as some blocks may occur in different orders and/or concurrently with other blocks from what is depicted and described herein. Any non-sequential, or branched, flow illustrated via a flowchart should be understood to indicate that various other branches, flow paths, and orders of the blocks, can be implemented which achieve the same or a similar result. Moreover, not all illustrated blocks may be required to implement the methods described hereinafter.

Exemplary Methods

For instance, as described above the disclosed subject matter can provide methods of power combining and/or power dividing. Thus, exemplary methods can facilitate power combining and/or power dividing by employing multi-way ring cavity power combiner or power divider (e.g., a power combiner 102 and/or a power divider 104, etc.), respectively.

Thus, FIG. 15 depicts a block diagram demonstrating methods 1500 in accordance with aspects of the disclosed subject matter. As can be appreciated, variations in the exemplary methods known to one having ordinary skill in the art may be possible without deviating from the intended scope of the subject matter as claimed. For example, the disclosed subject matter can facilitate power combining in the ring cavity (e.g., ring cavity 604) comprising transmitting one or more RF signal(s) (e.g., one or more input signal(s) 106) through one or more connector(s) (e.g., one or more type-SMA connector(s), other coaxial connector(s), other connector(s), etc.) at 1502. In addition, at 1504, power combining according to a non-limiting aspect can further comprise coupling the one or more RF signal(s) to a ring cavity (e.g., ring cavity 604) by one or more probes (e.g., one or more parallel probe(s) 406) associated with the one or more connector(s). For instance, the one or more probes can be equally spaced around the ring cavity, can be identical in shape, can be identical in size, etc., as further described herein. In a further non-limiting aspect, power combining according to the disclosed subject matter can also comprise combining the one or more RF signal(s) in the ring cavity (e.g., ring cavity 604) thereby creating a combined signal at 1506. In addition, at 1508 power combining can further comprise transmitting the combined signal from the ring cavity (e.g., ring cavity 604) to an output port (e.g., output port 302) through an impedance matching circuit (e.g., taper feed 404, an impedance matching and/or transition circuit, and so on, or portions thereof, etc.), according to a non-limiting aspect. For example, an impedance matching circuit can comprise a coaxial taper or coaxial stepped impedance transformer and so on as further described herein.

In a further example, FIG. 16 depicts a block diagram demonstrating additional methods 1600 in accordance with aspects of the disclosed subject matter. Accordingly, the disclosed subject matter can facilitate power dividing in the ring cavity (e.g., ring cavity 604) comprising transmitting an input RF signal (e.g., input signal 110) through a connector (e.g., a type-N connector, coaxial connectors, other connector, etc.) at 1602. Additionally, at 1604, power dividing according to a non-limiting aspect can further comprise sending the input RF signal (e.g., input signal 110) from the connector to a ring cavity (e.g., ring cavity 604). For instance, as described herein, a signal can be sent with least refection to the ring cavity (e.g., ring cavity 604) by, for example, sending the input RF signal (e.g., input signal 110) through an impedance matching and/or transmission circuit (e.g., taper feed 404, an impedance matching and/or transition circuit, and so on, or portions thereof, etc.), such as a coaxial taper or a coaxial stepped impedance transformer and so on, in non-limiting implementations. In a further non-limiting aspect, power dividing according to the disclosed subject matter can also comprise splitting the input RF signal into one or more parallel probe(s) (e.g., one or more parallel probe(s) 406, one or more coaxial probe(s), etc.) in the ring cavity (e.g., ring cavity 604) at 1606, thereby creating one or more divided RF signal(s) associated with the one or more parallel probe(s). For instance, the one or more probes (e.g., one or more parallel probe(s) 406) can be equally spaced around the ring cavity, can be identical in shape, and/or can be identical in size, etc., as further described herein. In addition, at 1608 power dividing can further comprise transmitting the one or more divided RF signal(s) from the ring cavity to one or more ports (e.g., one or more port(s) 206 comprising one or more type-SMA connector(s), other coaxial connector(s), other connector(s), etc.) associated with the one or more parallel probes (e.g., one or more parallel probe(s) 406).

While the disclosed subject matter has been described in connection with the preferred embodiments of the various figures, it is to be understood that other similar embodiments may be used with, or modifications and additions may be made to, the described embodiments for performing the same function of the disclosed subject matter without deviating therefrom. For example, one skilled in the art will recognize that aspects of the disclosed subject matter as described in the various embodiments of the present application may apply to other RF applications involving power combining and/or power dividing.

As a further example, variations of process parameters (e.g., dimensions, configurations, numbers of ports, placement of ports, probe types, connector types, matching circuitry variations, process step order, etc.) may be made to further optimize the provided structures, devices and methods, as shown and described herein. In any event, the structures and devices, as well as the associated methods, described herein have many applications in outlet or connector design and manufacturing. Therefore, the disclosed subject matter should not be limited to any single embodiment described herein, but rather should be construed in breadth and scope in accordance with the appended claims.

What is claimed is:

1. A method of power combining, comprising:

transmitting a plurality of radio frequency (RF) signals through a plurality of parallel connectors, wherein the plurality of RF signals are transmitted through respective connectors of the plurality of parallel connectors;

coupling the plurality of RF signals to a ring cavity by a plurality of probes associated with the plurality of parallel connectors, wherein the ring cavity comprises an annular region comprising an inner diameter and an outer diameter encompassing the plurality of probes and having a constant cross-section regardless of a number of the plurality of probes coupling the plurality of RF signals;

combining the plurality of RF signals in the ring cavity thereby creating a combined RF signal; and transmitting the combined RF signal from the ring cavity to an output port through an impedance matching circuit.

2. The method of claim 1, wherein the transmitting the plurality of RF signals includes transmitting the plurality of RF signals through at least one of a type-N connector, a subminiature version A (type-SMA) connector, or a coaxial connector.

3. The method of claim 1, wherein the plurality of probes comprise at least one of an equal spacing within the ring cavity, an identical shape, an identical size, or a probe length defined by $\lambda_8/4$, where $\lambda_8$ is a wavelength at central frequency for a predetermined application of the power combining.

4. The method of claim 1, wherein the plurality of probes comprise at least one of a plurality of coaxial probes or a plurality of microstrip probes.

5. The method of claim 1, wherein the impedance matching circuit comprises a coaxial taper feeding port having a continuously tapering annular region from a first region proximate to the ring cavity to a second region proximate to the output port.

6. The method of claim 1, wherein the transmitting the combined RF signal through the impedance matching circuit includes transmitting the combined RF signal through a coaxial stepped impedance transformer.

7. A method of power dividing comprising:

transmitting an input radio frequency (RF) signal through a connector;

sending the input RF signal from the connector to a ring cavity comprising an inner diameter and an outer diameter and comprising an annular region surrounding a plurality of parallel probes and maintaining a constant cross-section independent of a number of the plurality of parallel probes;

splitting the input RF signal into the plurality of parallel probes in the ring cavity including generating a plurality of divided RF signals, each associated with one of the plurality of parallel probes;

transmitting the plurality of divided RF signals from the ring cavity to a plurality of ports associated with the plurality of parallel probes.

8. The method of claim 7, wherein the transmitting the input RF signal through the connector includes transmitting the input RF signal through at least one of a type-N connector, a subminiature version A (type-SMA) connector, or a coaxial connector.

9. The method of claim 7, wherein the plurality of parallel probes comprise at least one of an equal spacing around the ring cavity, an identical shape, an identical size, or a probe length defined by $\lambda_8/4$, where $\lambda_8$ is a wavelength at central frequency for a predetermined application of the power dividing.

10. The method of claim 7, wherein the plurality of parallel probes comprise at least one of a plurality of coaxial parallel probes or a plurality of microstrip parallel probes.

11. The method of claim 7, wherein the sending the input RF signal from the connector to the ring cavity includes passing the input RF signal through an impedance matching circuit comprising at least one of a coaxial taper feeding port or a coaxial stepped impedance transformer.

12. The method of claim 11, wherein input RF signal passes through a continuously tapering annular region from a first region proximate to the ring cavity to a second region proximate to the connector.

13. A device comprising:

a first port;

a ring cavity comprising an inner diameter and an outer diameter and comprising an annular region encompassing a plurality of parallel probes associated with a plurality of second ports, wherein the annular region is characterized by a pre-determined cross-section independent of a number of the plurality of parallel probes; and an impedance matching circuit adapted to match impedance between the first port and the ring cavity.

14. The device of claim 13, wherein at least one of the first port or the plurality of second ports at least one of a type-N connector, a subminiature version A (type-SMA) connector, or a coaxial connector.

15. The device of claim 13, wherein the plurality of parallel probes comprise at least one of a plurality of coaxial parallel probes or a plurality of microstrip parallel probes.

16. The device of claim 13, wherein the impedance matching circuit comprises at least one of a coaxial taper feeding port having a continuously tapering annular region from a first region proximate to the ring cavity to a second region proximate to the first port or a coaxial stepped impedance transformer.

17. The device of claim 13, wherein the first port is configured as an input port, the plurality of second ports are configured as a plurality of output ports, and the device is configured as a power divider.

18. The device of claim 13, wherein the first port is configured as an output port, the plurality of second ports are configured as a plurality of input ports, and the device is configured as a power combiner.

19. The device of claim 13, wherein the plurality of parallel probes is further configured with at least one of an equal spacing around the ring cavity, an identical shape, an identical size, or a probe length defined by $\lambda_8/4$, where $\lambda_8$ is a wavelength at central frequency for a predetermined application of the device.

20. The device of claim 19, wherein the plurality of parallel probes is further configured with probe length defined by $\lambda_8/4$, where $\lambda_8$ is the wavelength at central frequency for the predetermined application of the device, and where the central frequency for the predetermined application lies in a frequency range from 3.1 to 10.6 GigaHertz (GHz).

21. A power divider comprising:

an input port;

a plurality of parallel output ports; and a means for dividing a radio frequency signal in a ring cavity between the input port and the plurality of parallel output ports, wherein the ring cavity comprises an annular region characterized by an inner diameter and an outer diameter and a constant cross-section independent of a number of the plurality of parallel output ports.

22. A power combiner comprising:

a plurality of parallel input connectors for accepting a plurality of input radio frequency (RF) signals;

an output connector; and a means for combining the plurality of input RF signals in a ring cavity between the plurality of parallel input connectors and the output connector, wherein the ring cavity comprises an inner diameter and an outer diameter defining an annular region having a cross-section that is independent of a number of the plurality of parallel input connectors.

* * * * *